US006670977B2

(12) United States Patent
Nakanishi et al.

(10) Patent No.: US 6,670,977 B2
(45) Date of Patent: Dec. 30, 2003

(54) IMAGE-RECORDING METHOD AND IMAGE-RECORDING SYSTEM

(75) Inventors: Kanji Nakanishi, Saitama-ken (JP); Shintaro Washizu, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/854,945

(22) Filed: May 15, 2001

(65) Prior Publication Data

US 2002/0063769 A1 May 30, 2002

(30) Foreign Application Priority Data

May 15, 2000 (JP) ..... 2000-141742

(51) Int. Cl.[7] ..... B41J 2/435
(52) U.S. Cl. ..... 347/228
(58) Field of Search ..... 347/173, 228, 347/232, 262, 264, 139, 140; 355/405, 27; 430/203; 250/584

(56) References Cited

U.S. PATENT DOCUMENTS

| | | | | | |
|---|---|---|---|---|---|
| 4,734,704 | A | * | 3/1988 | Mizutani et al. | 347/173 |
| 4,760,426 | A | * | 7/1988 | Taniguchi et al. | 355/405 |
| 4,864,352 | A | * | 9/1989 | Morita | 355/27 |
| 4,906,847 | A | * | 3/1990 | Nakajima et al. | 250/584 |
| 5,091,281 | A | * | 2/1992 | Nakamura et al. | 430/203 |
| 6,295,081 | B1 | * | 9/2001 | Kashima et al. | 347/262 |

* cited by examiner

*Primary Examiner*—Hai Pham
(74) *Attorney, Agent, or Firm*—Sughrue Mion, PLLC

(57) ABSTRACT

An image-recording system with a first conveying path along which a light and heat sensitive recording material is conveyed from an accommodating cassette at an accommodating section toward a pair of conveying rollers, a second conveying path along which the recording material is conveyed forward and backward through an optical recording section and a heat-developing section, and a third conveying path along which the recording material, after development of an image thereon, is conveyed to an optical fixing section.

20 Claims, 13 Drawing Sheets

IMAGE-RECORDING METHOD AND IMAGE-RECORDING SYSTEM

BACKGROUND OF THE INVENTION

1. Field of the Invention

The present invention relates to an image-recording method and an image-recording system, and more particularly to an image-recording method and an image-recording system in which a light and heat sensitive recording material is exposed to record a latent image thereon and then is heated to develop the latent image.

2. Description of the Related Art

In a conventional optical recording system such as silver halide photography, a subject is photographed using a photographic film such as a negative film or a positive film, and the photographic film is developed. A recording material such as photographic printing paper or plain paper is optically exposed, on the basis of image information recorded on the developed photographic film, to form a latent image, and the recording material is processed to render the latent image visible and obtain a print. In the following description, photographic film means a film which has been used to photograph a subject and developed to render visible a negative image or a positive image. Thus, in order to obtain a print from the photographic film, image information recorded on the photographic film has to be rendered visible on a recording material. In recent years, image information has been made visible using recording materials which do not require developing and fixing materials such as treating fluid or toner. Such recording materials include, for example, a light and heat sensitive recording material, onto which image information is optically exposed to obtain a latent image, which latent image is made visible and fixed by heat-development.

When such a light and heat sensitive recording material is used, a process which renders visible the obtained latent image by optically exposing image information by heating and fixes the image is required. A latent image-recording process and a heat-development process are difficult to carry out simultaneously, and therefore have to be carried out separately. As a result, image-recording systems for recording an image onto a light and heat sensitive recording material have been provided with respective processing sections disposed sequentially along a conveying path of the light and heat sensitive recording material, such that at least the latent image-recording and the heat-development are carried out separately.

However, when these sections for respective processes are provided sequentially along the conveying path of the light and heat sensitive recording material, the system becomes large. Therefore, the conveying path of the light and heat sensitive recording material has been made to meander, and the sections for respective processes have been stacked to make the system more compact.

However, even when the conveying path of the light and heat sensitive recording material has been made to meander and the sections for respective processes stacked, the system as a whole has necessarily become large, since the sections have merely been stacked.

SUMMARY OF THE INVENTION

In view of the above, an object of the present invention is to provide an image-recording method and an image-recording system which can each record an image onto a light and heat sensitive recording material with a compact system having a simple structure.

In order to accomplish the above-described object, an image-recording method of the present invention is an image-recording method for exposing a light and heat sensitive recording material to record a latent image thereon and then heating to develop the latent image, the method including the steps of: recording the latent image by exposing the light and heat sensitive recording material with light while conveying the light and heat sensitive recording material in one direction; and developing the latent image by heating while conveying the light and heat sensitive recording material in an opposite direction which is opposite to the one direction.

In the image-recording method of the present invention, the light and heat sensitive recording material is exposed to light to record the latent image. The light and heat sensitive recording material includes a light and heat sensitive recording layer. By exposing with light and heating the light and heat sensitive recording layer, an exposed portion thereof forms color, or an unexposed portion thereof forms color. The light and heat sensitive recording layer may be formed of a single layer of one color to form a monochromatic image, or may be formed of a plurality of layers to form a color image. The latent image is developed by heating. After development, the developed image can be fixed by irradiating light onto the image. When the latent image is recorded, the light and heat sensitive recording material is exposed to light while being conveyed in the one direction. When the latent image is developed, the light and heat sensitive recording material is heated while being conveyed in the direction opposite to the conveying direction of the time of latent image-recording. That is, the light and heat sensitive recording material is exposed to light to record the latent image and heated to develop the latent image while being conveyed forward and backward on a conveying path: the recording is carried out in a forward direction, and the development is carried out in a backward direction. Thus, since the image is recorded only by conveying the light and heat sensitive recording material forward and backward on the conveying path, sections for respective processes can be overlapped and the system can be made more compact. Since the light and heat sensitive recording material is recorded with the latent image in the forward direction and heat-developed in the backward direction, conveyance for latent image-recording and heat-development can be dissociated. Therefore, a conveying speed for each process can be stabilized without being affected by the other process.

The above-described image-recording method can be accomplished by the following image-recording system. Specifically, an image-recording system for recording an image, the system including: an optical recording section which exposes a light and heat sensitive recording material with light and records a latent image; a heat-developing section which develops the latent image by heating; a conveying mechanism which conveys the light and heat sensitive recording material; and a conveyance-control device which controls the conveying mechanism such that the light and heat sensitive recording material is conveyed in one direction along a predetermined conveying path when the latent image is being recorded at the optical recording section, and the light and heat sensitive recording material is conveyed in an opposite direction, which is opposite to the one direction, along the conveying path when the latent image is being developed at the heat-developing section.

The image-recording system of the present invention records the latent image by exposing the light and heat sensitive recording material with light at the optical recording section. The light and heat sensitive recording material includes the light and heat sensitive recording layer explained above. The latent image is developed by being heated at the heat-developing section. Further, an optical fixing device for fixing the developed image by irradiating light may be provided. The conveyance of the light and heat sensitive recording material is controlled by the conveyance-controlling device at least when recording the latent image and during heat-development. That is, the conveyance-controlling device controls such that the light and heat sensitive recording material is conveyed in the one direction on the predetermined conveying path when the latent image is recorded at the optical recording section, and the light and heat sensitive recording material is conveyed in the direction opposite to the one direction on the conveying path when the latent image is developed at the heat-developing section. Since the image can be recorded just by conveying the light and heat sensitive recording material forward and backward on the conveying path, sections for respective processes can be overlapped and the system can be made more compact.

The conveyance-controlling device can control such that the light and heat sensitive recording material is conveyed to a predetermined waiting site after it has been conveyed in the one direction on the conveying path, and is then conveyed from the waiting site in the direction opposite to the one direction.

The light and heat sensitive recording material is conveyed in the one direction on the conveying path when the latent image is being recorded thereon, and then is conveyed to the waiting site. The light and heat sensitive recording material is conveyed from the waiting site in the direction opposite to that at the time of the latent image-recording. Therefore, between the latent image-recording process and the heat-development process, the light and heat sensitive recording material can be held at the waiting site, and transition to the next process can be halted. Therefore, the processes can be carried out efficiently even if there is a difference between the processing times or there is an interruption between the steps.

The image-recording system is further provided with an accommodating section for accommodating light and heat sensitive recording materials of a predetermined size and a feeding device for feeding the light and heat sensitive recording materials of the predetermined size from the accommodating section. The conveyance-controlling device can cause a light and heat sensitive recording material fed by the feeding device to be conveyed.

Sheets of paper which have been cut to a predetermined size may be used as the light and heat sensitive recording material. Flexibility of the system is improved by accommodating the light and heat sensitive recording materials of the predetermined size in the accommodating section, and having the light and heat sensitive recording materials fed from the accommodating section by the feeding device and conveyed.

The image-recording system is further provided with a paper supply device for accommodating a long light and heat sensitive recording material, and a taking-out device for taking out the light and heat sensitive recording material from this paper supply device. The conveyance-controlling device can cause the light and heat sensitive recording material taken out by the taking-out device to be conveyed.

A long roll of paper may be used as the light and heat sensitive recording material. Use of the long roll of paper is enabled by accommodating this long light and heat sensitive recording material in the paper supply device, and having the light and heat sensitive recording material taken out from the paper supply device by the taking-out device and conveyed, thereby improving flexibility.

In this case, the image-recording system may be further provided with a cutting device for cutting the light and heat sensitive recording material taken out by the taking-out device. By suitably cutting the long roll of paper with the cutting device, the light and heat sensitive recording material can be obtained at a desired size.

The cutting device can cut the light and heat sensitive recording material after the light and heat sensitive recording material is taken out and before a latent image is recorded thereon, or after the recording and before the development, or after the development.

When the light and heat sensitive recording material is cut at a point between the taking-out and the latent image-recording, the long light and heat sensitive recording material can be treated from an early stage in the same way as the sheets of paper cut to the predetermined size in advance. If the light and heat sensitive recording material is cut at a point between the taking-out thereof and the latent image-recording thereon, the size of an area at which the latent image is actually to be recorded can be taken into account, and if the light and heat sensitive recording material is cut at a point after the development, the size of an image that has actually been developed can be taken into account.

As described above, in accordance with the present invention, a latent image is recorded while a light and heat sensitive recording material is conveyed in one direction, and then the latent image is developed while the light and heat sensitive recording material is conveyed in an opposite direction. Therefore, recording and heat-development of the latent image on the light and heat sensitive recording material can be carried out by conveying the light and heat sensitive recording material forward and backward on the same conveying path. This allows sections for respective processes to be overlapped, thereby making the system more compact.

DESCRIPTION OF THE PREFERRED EMBODIMENTS

Hereinafter, exemplary embodiments of the present invention are described in detail with reference to the figures. The present embodiments apply the present invention to an image-recording system which records an image using a color light and heat sensitive recording material. In the present embodiments, a color light and heat sensitive recording material which includes three laminated monochromatic light and heat sensitive recording layers, each of which forms a color corresponding to one of yellow, magenta and cyan (hereinafter referred to as "light and heat sensitive recording material") is used.

First Embodiment

Figure 1:
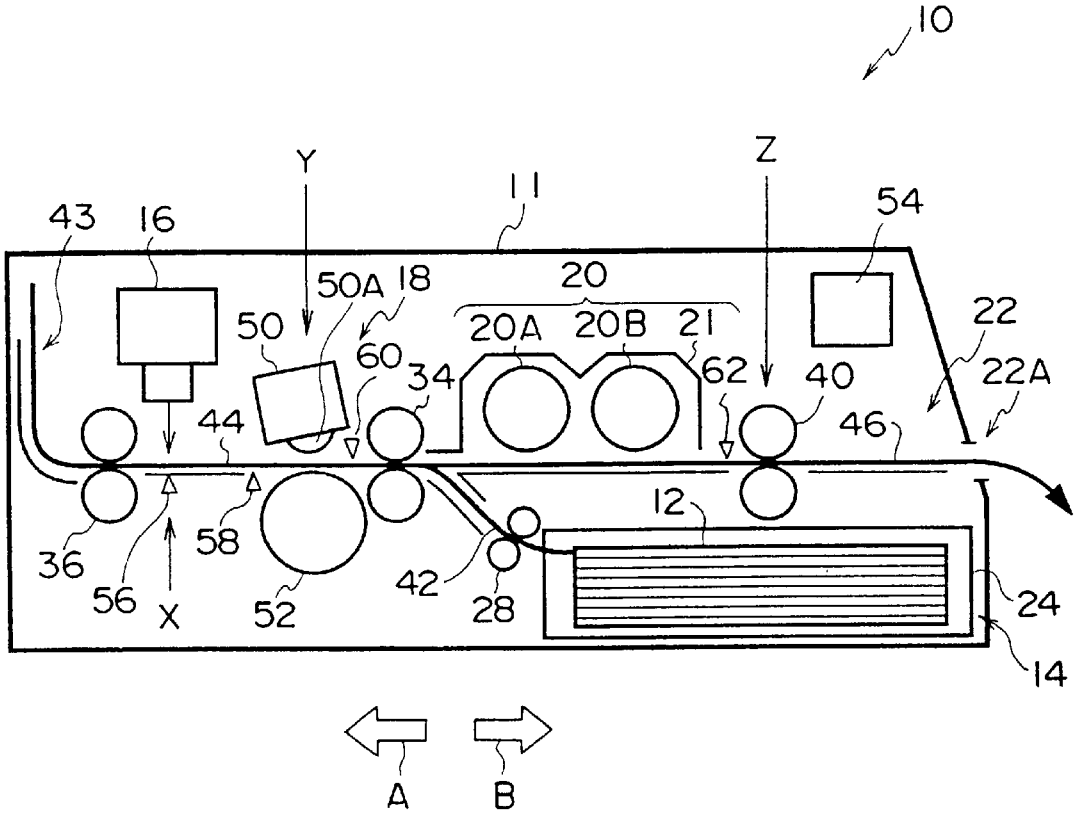
FIG. 1 is a schematic view showing a schematic structure of an image-recording system relating to a first embodiment of the present invention.

FIG. 1 shows schematic internal structure of an image-recording system 10 that uses a light and heat sensitive recording material 12. As shown in FIG. 1, in a body 11 of the image-recording system 10 are provided: an accommodating section 14 for accommodating the light and heat sensitive recording material 12, which has been cut to a predetermined size, an optical recording section 16 for exposing the light and heat sensitive recording material 12 fed from the accommodating section 14 with light to record a latent image, a heat-developing section 18 for developing the latent image by heating, an optical fixing section 20 for fixing the developed image by irradiating light onto the image, and an ejecting section 22 for ejecting the light and heat sensitive recording material 12 recorded with the image. The ejecting section 22 is provided with an ejection port 22A for ejecting the light and heat sensitive recording material 12 outside.

The accommodating section 14 is provided at a lower portion of the body 11 of the image-recording system 10 and, in the present embodiment, an accommodating cassette 24 for accommodating the light and heat sensitive recording material 12 at a predetermined size (e.g., A4 size) is provided. A plurality of accommodating cassettes may be provided, to accommodate light and heat sensitive recording materials of different widths (e.g., A4 and A6 widths) or light and heat sensitive recording materials of the same size. A pair of conveying rollers 28 for nipping and conveying the light and heat sensitive recording material 12 are provided at the accommodating section 14, at a light and heat sensitive recording material 12 ejecting side of the accommodating cassette 24.

Pairs of conveying rollers 34 and 36, which can rotate forward and backward (bidirectionally), are provided downstream in a light and heat sensitive recording material 12 conveying direction from the pair of conveying rollers 28. The heat-developing section 18 and the optical recording section 16 are sequentially provided along the conveying direction from the pair of conveying rollers 34 (the direction of arrow A in FIG. 1). A pair of conveying rollers 40 are provided at the ejecting section 22, downstream from the pair of conveying rollers 34 in a direction which is opposite to the conveying direction (the direction of arrow B in FIG. 1).

A conveying path 42 is formed for conveying the light and heat sensitive recording material 12 from the accommodating cassette 24 of the accommodating section 14 toward the pair of conveying rollers 34 via the pair of conveying rollers 28 (in the direction of arrow A in FIG. 1, the conveying direction). Further, a conveying path 44 is formed for conveying the light and heat sensitive recording material 12 so as to be passed through the optical recording section 16 and the heat-developing section 18 by the pairs of conveying rollers 34 and 36 (bidirectionally, in the direction of arrow A in FIG. 1, the conveying direction, or in the direction of arrow B in FIG. 1, the direction opposite to the conveying direction). Furthermore, a conveying path 46 is formed for conveying the light and heat sensitive recording material 12, which has passed through the heat-developing section 18, so as to be passed through the optical fixing section 20 by the pairs of conveying rollers 34, 36 and 40 (in the direction of arrow B, the direction opposite to the conveying direction). Thus, the light and heat sensitive recording material 12 accommodated in the accommodating cassette 24 is conveyed from the accommodating section 14, through the heat-developing section 18, to the optical recording section 16, and then is switched back to be conveyed through the optical recording section 16, the heat-developing section 18 and the optical fixing section 20, and is ejected through the ejecting section 22 to the outside of the body 11 of the image-recording system 10.

Figure 4:
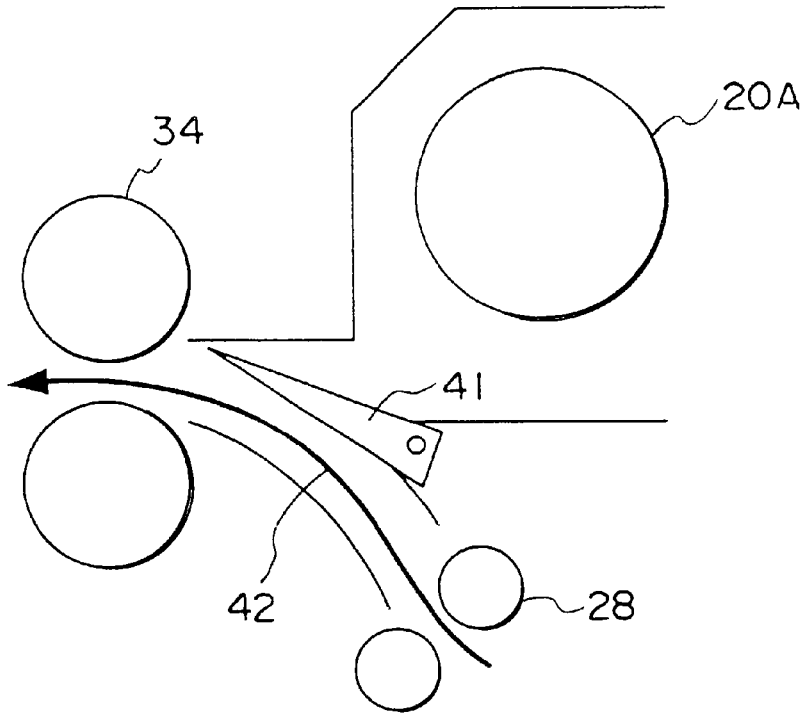
FIG. 4 is a schematic view showing a switching member for switching between conveying paths to make a conveying path usable in the image-recording system relating to the embodiment of the present invention.
Figure 5:
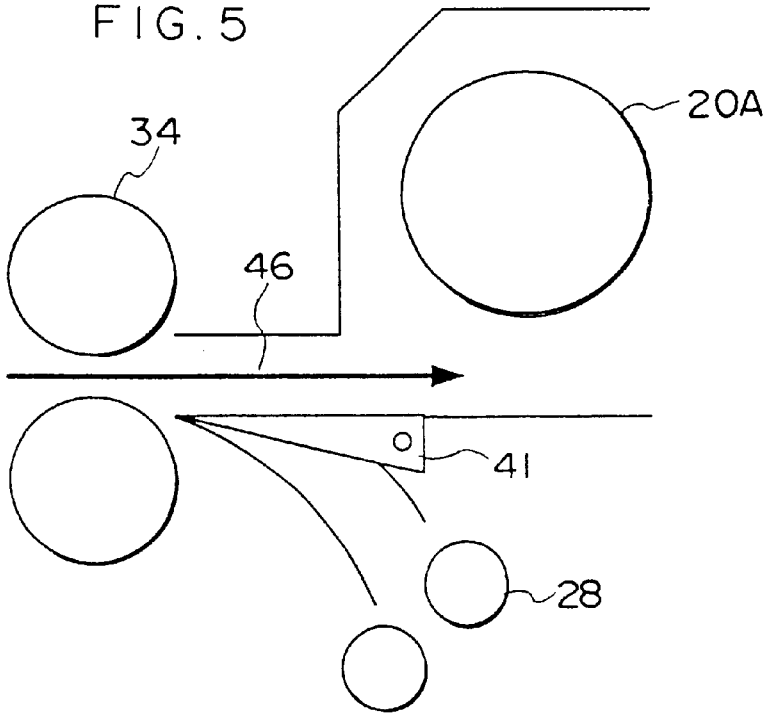
FIG. 5 a schematic view showing the switching member for switching between the conveying paths to make a conveying path usable in the image-recording system relating to the embodiment of the present invention.

The light and heat sensitive recording material 12 is conveyed from the conveying path 42 to the conveying path 44, and then is conveyed backward on the conveying path 44 toward the conveying path 46. The light and heat sensitive recording material 12 conveyed backward must be reliably conveyed from the pair of conveying rollers 34 to the conveying path 46, so that the light and heat sensitive recording material 12 does not return to the accommodating section 14. To this end, as shown in FIGS. 4 and 5, a switching member 41 for switching between the conveying path 42 and the conveying path 46, when the light and heat sensitive recording material 12 is conveyed in the conveying direction (the direction of arrow A in FIG. 1) and when the same is conveyed in the direction opposite to the conveying direction (the direction of arrow B in FIG. 1), is provided. As shown in FIG. 4, when the light and heat sensitive recording material 12 is to be conveyed along the conveying path 42 in the conveying direction (the direction of arrow A in FIG. 1), the switching member 41 opens the conveying path 42 and the light and heat sensitive recording material 12 proceeds toward the pair of conveying rollers 34. On the other hand, when the light and heat sensitive recording material 12 is to be conveyed along the conveying path 46 in the direction opposite to the conveying direction (the direction of arrow B in FIG. 1), the switching member 41 closes the conveying path 42 and the light and heat sensitive recording material 12 proceeds toward the optical fixing section 20.

The pairs of conveying rollers 28, 34, 36 and 40 are connected to a conveyance driving section (not shown), and are respectively driven by the unillustrated conveyance driving section.

The light and heat sensitive recording material 12 is accommodated in the accommodating cassette 24 of the accommodating section 14 with a light and heat sensitive recording layer side thereof facing upward. The light and heat sensitive recording material 12 is pulled out from the accommodating cassette 24 of the accommodating section 14 by the pair of conveying rollers 28, which nips the light and heat sensitive recording material 12 with the light and heat sensitive recording layer side thereof facing upward and rotates, and is conveyed along the conveying path 42 toward the pair of conveying rollers 34. The pair of conveying rollers 34 nips the light and heat sensitive recording material 12 and rotates to feed the light and heat sensitive recording material 12 to the optical recording section 16, which is disposed downstream in the conveying direction.

Figure 2:
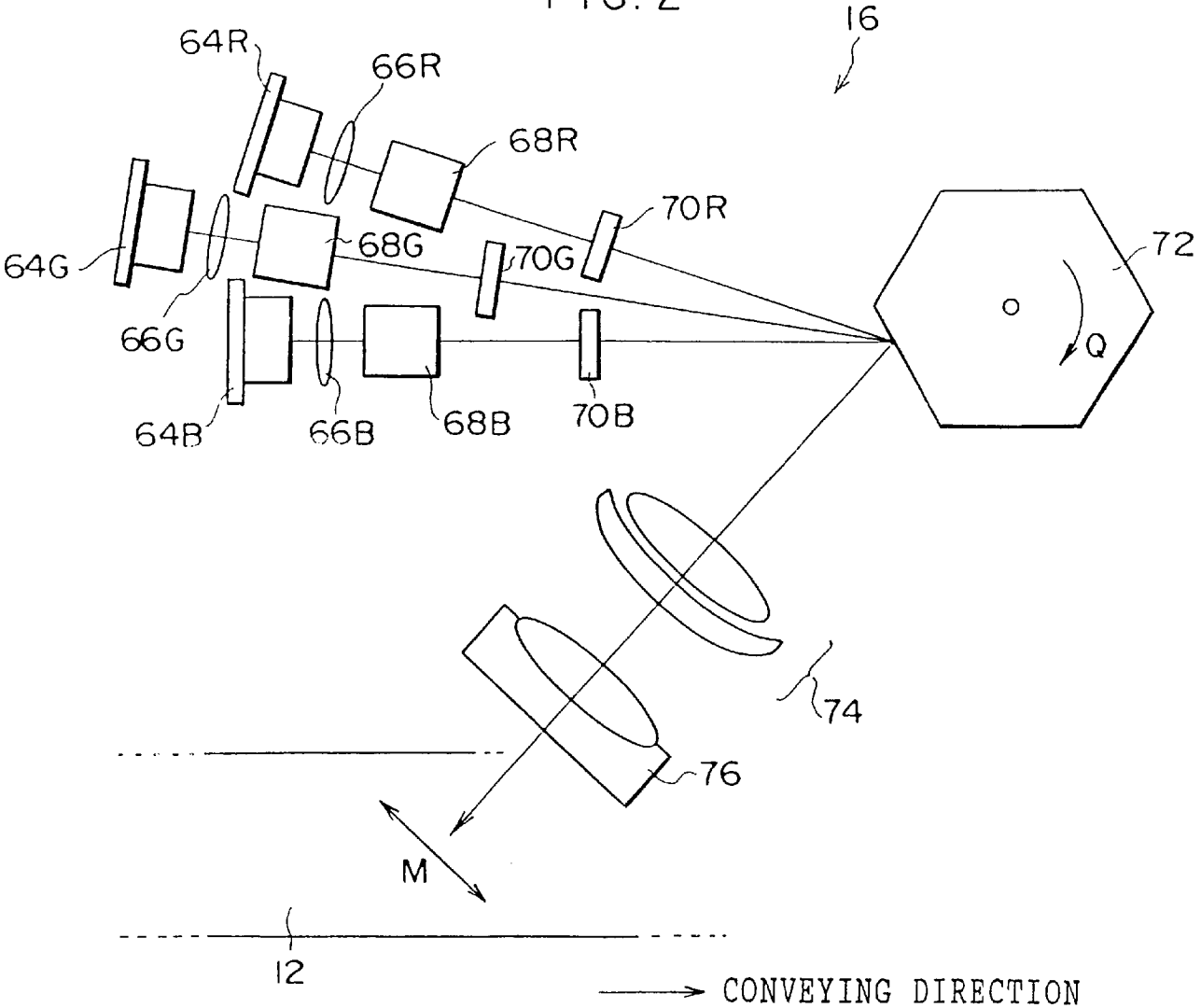
FIG. 2 is a schematic view showing a schematic structure of an optical recording section included in an image-recording system relating to an embodiment of the present invention.

The optical recording section 16 includes an RGB exposing unit. As shown in FIG. 2, the optical recording section 16 including the RGB exposing unit is provided with three laser sources for three colors. That is, a laser source 64R for red, a laser source 64G for green and a laser source 64B for blue. The laser sources for the respective colors are provided with corresponding collimator lenses 66R, 66G and 66B, light modulators 68R, 68G and 68B, which consist of acousto-optical modulators (AOMs) or the like, and cylindrical lenses 70R, 70G and 70B. The light modulators 68R, 68G and 68B are driven by a modulator-driving section (not shown). Further, a polygon mirror 72, an fθ lens 74 and a cylindrical lens 76 are disposed at a light emission side of the cylindrical lenses 70R, 70G and 70B.

Laser sources having a maximum intensity in a wavelength range of 300 to 1100 nm can be used as the laser sources 64R, 64G and 64B. Because there are no suitable laser sources with a wavelength shorter than 300 nm, the present embodiment employs, as the red laser source 64R, a semiconductor laser having a central oscillation wavelength of 680 nm, as the green laser source 64G, a semiconductor-laser-excited wavelength-conversion solid state laser having a central oscillation wavelength of 532 nm, and as the blue laser source 64B, a semiconductor-laser-excited wavelength-conversion solid state laser having a central oscillation wavelength of 473 nm.

The maximum quantity of irradiated light on the surface of the light and heat sensitive recording material 12 is preferably 0.01 to 50 mJ/cm$^2$, and more preferably 0.05 to 10 mJ/cm$^2$. If the maximum quantity of irradiated light is larger than 50 mJ/cm$^2$, the system will require a long time for exposure and convenience will be lost. Also, the system will be expensive since large light sources will be necessary. Considering a typical sensitivity of the light and heat sensitive recording material 12, the maximum quantity of irradiating light needs to be at least 0.01 mJ/cm$^2$. Even if the light and heat sensitive recording material 12 has high sensitivity, a maximum quantity of irradiating light of less than 0.01 mJ/cm$^2$ will necessitate provision of a light-shielding installation for shielding light interference, which will make the system expensive.

A laser beam from the laser source 64R is collimated by the collimator lens 66R and enters the light modulator 68R. The light modulator 68R modulates the intensity of the laser beam according to input modulation signals, and the intensity-modulated laser beam is converged on the surface of the polygon mirror 72 by the cylindrical lens 70R. The laser beam reflected from the polygon mirror 72 is corrected by the fθ lens 74 and the cylindrical lens 76, and focused on the light and heat sensitive recording material 12. The polygon mirror 72 is rotated by a polygon driving section (not shown) in the direction of arrow Q at a predetermined angular speed, and the light and heat sensitive recording material 12 is main-scanned in the direction of arrow M with the laser beam reflected from the polygon mirror 72. The above explanation also applies to laser beams from the laser sources 64G and 64B, and thus explanations thereof are omitted.

As shown in FIG. 1, the optical recording section 16 is provided above the conveying path 44, and a laser beam is emitted substantially vertically from the optical recording section 16. If the position of the emitted laser beam on the light and heat sensitive recording material 12 is designated exposure position X, the pair of conveying rollers 36 are provided in the vicinity of the exposure position X, downstream in the conveying direction (the direction of arrow A) from the exposure position of the laser beam. The pair of conveying rollers 34 are provided upstream of the exposure position of the laser beam. The light and heat sensitive recording material 12 is nipped by the pairs of conveying rollers 34 and 36, and is conveyed in the conveying direction (the direction of arrow A) along the conveying path 44. Thus, the light and heat sensitive recording material 12 is main-scanned by the laser beam reflected from the polygon mirror 72, and sub-scanned in the direction opposite to the conveying direction. Thus, the light and heat sensitive recording material 12 is exposed and a latent image is recorded thereon.

When the latent image has been recorded onto the light and heat sensitive recording material 12 by exposure, the light and heat sensitive recording material 12 is conveyed to a waiting position 43. When the light and heat sensitive recording material 12 has reached the waiting position, the pair of conveying rollers 36 is rotated in a reverse direction, and the light and heat sensitive recording material 12 is conveyed along the conveying path 44 in the direction opposite to the conveying direction (the direction of arrow B). Thus, the light and heat sensitive recording material 12 is fed to the heat-developing section 18 which is disposed downstream from the optical recording section 16 in the direction opposite to the conveying direction, that is, to the right in FIG. 1.

A position-detecting sensor 56 is provided in the vicinity of the exposure position X. The position-detecting sensor 56 detects the position of a leading edge of the light and heat sensitive recording material 12 conveyed from the accommodating section 14. An optical sensor or a magnetometric sensor can be employed as the position-detecting sensor 56. The position-detecting sensor 56 is connected to a controlling device 54 (see FIG. 3) described later.

The polygon driving section, the conveyance driving section and the modulator-driving section are included in the controlling device 54 described later, and are controlled synchronously with the exposure of the light and heat sensitive recording material 12, which is carried out on the basis of image data which has been subjected to image processing and retrieved from a RAM 114 which serves as an image memory.

The heat-developing section 18 is disposed next to the optical recording section 16 (to the right of the optical recording section 16 in FIG. 1). The heat-developing section 18 includes a thermal recording head 50, which serves as a heating device for heating the light and heat sensitive recording layer side (exposed surface side) of the light and heat sensitive recording material 12, and a platen roller 52, which is provided facing the thermal recording head 50 for nipping the light and heat sensitive recording material 12 with the thermal recording head 50. The platen roller 52 is structured so as to rotate along with conveyance of the light and heat sensitive recording material 12, and to nip the light and heat sensitive recording material 12 against the thermal recording head 50 such that the light and heat sensitive recording material 12 is pressed by the thermal recording head 50 with a constant pressing force. The thermal recording head 50 and the platen roller 52 are structured such that they can be brought into pressing-contact, and can be spaced apart from each other. When the thermal recording head 50 and the platen roller 52 are in pressing-contact, the thermal recording head 50 is pressed against the light and heat sensitive recording material 12, and when the same are spaced apart, pressure from the thermal recording head 50 against the light and heat sensitive recording material 12 is released.

Although the present embodiment is structured such that the light and heat sensitive recording material 12 is pressed against the thermal recording head 50 by the rotating platen roller 52, the light and heat sensitive recording material 12 may instead be pressed against the thermal recording head 50 by a fixed member.

The thermal recording head 50 includes a plurality of heating elements arranged in a line, and heating energies of the heating elements can be respectively adjusted. The plurality of heating elements of the thermal recording head 50 is disposed at a glazed convex portion 50A which is provided at the light and heat sensitive recording layer side (exposed surface side) of the light and heat sensitive recording material 12. In the present embodiment, shape of the glazed convex portion 50A is such that a radius of curvature at a distal end thereof is 4 mm, and thickness of the glaze is 200 $\mu$m. Hence, heating efficiency and contact-pressing efficiency can be improved by disposing the heating elements at this glazed convex portion 50A. In this case, a preferable shape of the thermal recording head 50 is such that length of a heating element in the sub-scanning direction is 275 $\mu$m, with the thickness of the glaze being 200 $\mu$m. The conveying speed of the light and heat sensitive recording material 12 is preferably 8 mm/sec.

The thermal recording head 50 may be provided with a temperature sensor, and the thermal recording head 50 may be controlled according to a detected temperature such that the thermal recording head 50 can heat the light and heat sensitive recording material 12 to a predetermined temperature. In the heat-developing section 18, the light and heat sensitive recording material 12 is heated by the thermal recording head 50 to the predetermined temperature, and thus the latent image recorded on the light and heat sensitive recording material 12 is developed.

The heating temperature is higher than or equal to a developing temperature of the light and heat sensitive recording material 12, and is preferably 50 to 300° C., and more preferably 120 to 250° C. If the heating temperature is low, preservability of the photosensitive material before exposure will be significantly impaired, and thus design of the light and heat sensitive recording material will be difficult. On the other hand, if the heating temperature is high, a support of the light and heat sensitive recording material will be deformed by heat and dimensional stability thereof cannot be ensured. The heating temperature is controlled such that variations thereof with respect to a set temperature are within a range of ±5° C. The light and heat sensitive recording material has a relatively wide latitude with respect to temperature variations, and provided that the variation range is within ±5° C., performance can be ensured.

Color formation during heat development depends on the amount of thermal energy which is supplied. That is, heating time is relevant as well as temperature. In the present embodiment, the thermal recording head 50 is controlled to provide a sufficient amount of thermal energy to the light and heat sensitive recording material 12 such that the light and heat sensitive recording material 12 is heated to the predetermined temperature, which is sufficient for color formation thereof. The amount of thermal energy is preferably in a range of 20 to 200 mJ/mm$^2$. More specifically, the amount of thermal energy is preferably in a range from (120° C.×1 msec.) to (250° C.×500 msec.). The amount of thermal energy in those two ranges is what should be supplied from the thermal recording head 50 and should be sufficient for causing preferable color formation in the light and heat sensitive recording material 12.

Position-detecting sensors 58 and 60 are provided in the vicinity of the thermal recording head 50 and the platen roller 52, which together form the heat-developing section 18. The position-detecting sensors 58 and 60 detect the position of heating-development and the position of the leading edge of the light and heat sensitive recording material 12 conveyed from the optical recording section 16. Optical sensors or magnetometric sensors can be employed as the position-detecting sensors 58 and 60. That is, because the conveying speed of the light and heat sensitive recording material 12 is kept constant, the position of the light and heat sensitive recording material 12 along the conveying path 46 can be determined from the times at which the leading edge of the light and heat sensitive recording material 12 passes the position-detecting sensors 58 and 60. The position-detecting sensors 58 and 60 are connected to the controlling device 54 (see FIG. 3) described later. In the present embodiment, a predetermined position in the vicinity of the heat-development position is designated position Y.

The light and heat sensitive recording material 12 which has been subjected to the heat-development is nipped by the pair of conveying rollers 34 which are downstream from the heat-developing section 18 in the direction opposite to the conveying direction, is conveyed along the conveying path 46, and is supplied to the optical fixing section 20 which is disposed downstream in the conveying direction. At this time, the switching member 41 closes the conveying path 42 (see FIG. 5) and the light and heat sensitive recording material 12 proceeds toward the optical fixing section 20.

The optical fixing section 20 includes fixing light sources 20A and 20B, which irradiate light onto an imaging surface of the developed light and heat sensitive recording material 12, and a reflector 21, which is disposed behind the fixing light sources 20A and 20B. The fixing light sources 20A and 20B are disposed above the conveying path 46, that is, at the light and heat sensitive recording layer side of the light and heat sensitive recording material 12. In the optical fixing section 20, the light and heat sensitive recording material 12 is irradiated by light from the fixing light sources 20A and 20B, and the developed image is fixed.

As each fixing light source, a white light source such as a fluorescent light can be used, as well as various other light sources such as LEDs, halogen lamps, cathode ray tubes, lasers and the like. An illuminance at the irradiated portion of the light and heat sensitive recording material 12 is sufficient provided it is within a range in which a light intensity necessary for fixing is obtained, and is basically selected according to properties of the light and heat sensitive recording material 12. Preferably, the range is from 10,000 to 50,000,000 lux·s, and more preferably from 20,000 to 6,000,000 lux·s. If the illuminance is less than 10,000 lux·s, optical fixing (photo-decolorization) will not be sufficient. If the system requires an illuminance larger than 50,000,000 lux·s, the system will be large and expensive, and therefore convenience will be lost.

The pair of conveying rollers 40 is disposed downstream from the optical fixing section 20 in the conveying direction. The light and heat sensitive recording material 12 which has been subjected to optical fixing is nipped by the pair of conveying rollers 40, is conveyed along the conveying path 46, and is fed to the ejecting section 22 which is downstream in the conveying direction. The light and heat sensitive recording material 12 is conveyed, or ejected, from the ejection port 22A of the ejecting section 22 to the outside of the system.

A position-detecting sensor 62 is provided between the optical fixing section 20 and the ejecting section 22. The position-detecting sensor 62 detects a visible image position or a leading (trailing) edge position of the light and heat sensitive recording material 12 conveyed from the optical fixing section 20. An optical sensor or a magnetometric sensor can be employed as the position-detecting sensor 62. That is, because the conveying speed of the light and heat sensitive recording material 12 is kept constant, the position of the light and heat sensitive recording material 12 on the conveying path 46 can be derived from the time at which the leading or trailing edge of the light and heat sensitive recording material 12 passes the position-detecting sensor 62. The position-detecting sensor 62 is connected to the controlling device 54 (see FIG. 3) described later. In the present embodiment, a predetermined position at the ejecting section 22 is designated position Z.

In this system, all processes, including optical recording, heat-development and optical fixing, can be carried out on the light and heat sensitive recording material in a single system. Further, since development is effected by heat-development and the developed image is fixed by optical fixing in this system, no treatment solution is required, and a completely dry system is accomplished. Also, no image-receiving member or the like is required, and waste is not produced.

Figure 3:
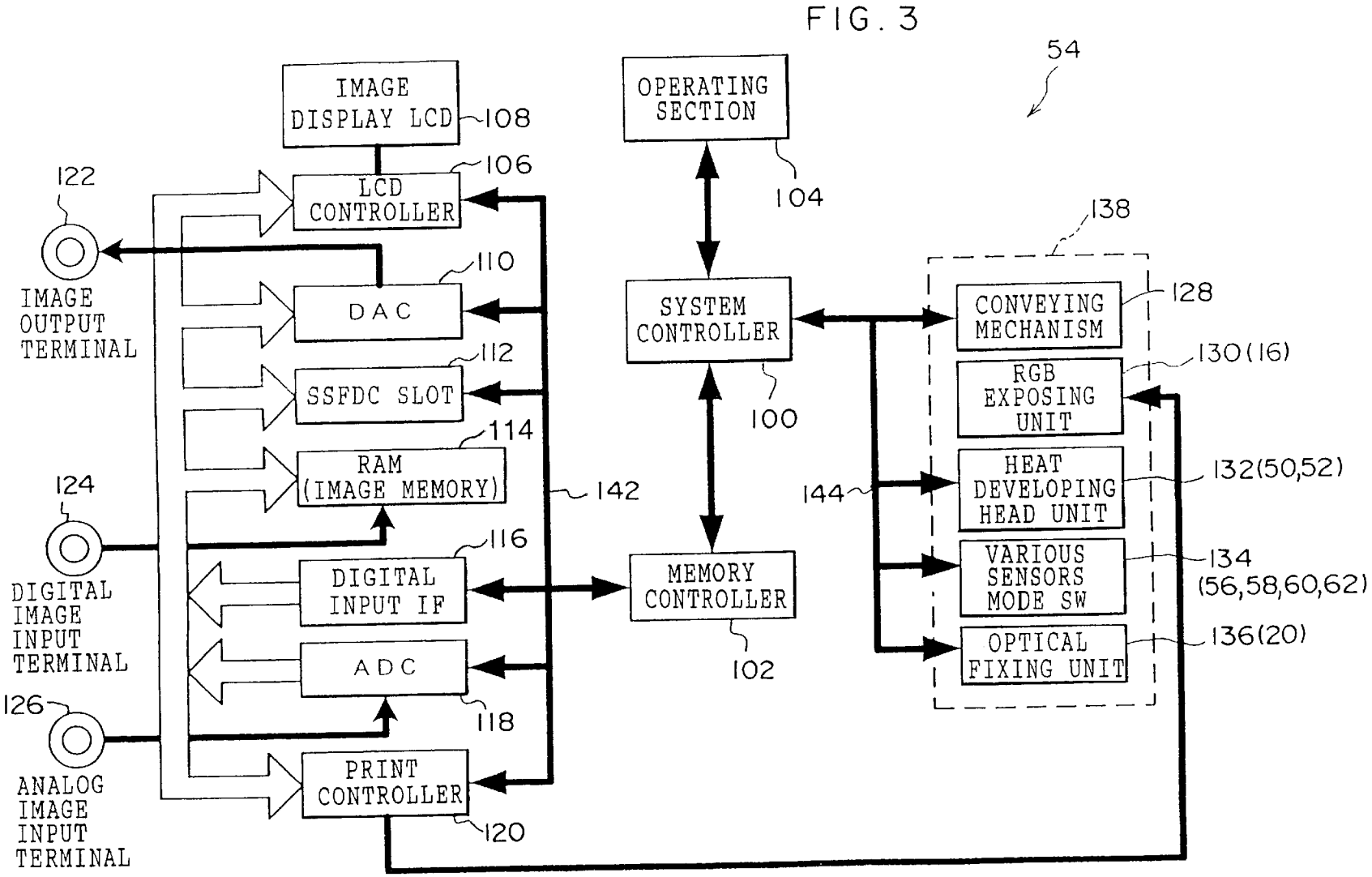
FIG. 3 is a schematic view showing a schematic structure of a controlling device included in the image-recording system relating to an embodiment of the present invention.

Next, the controlling device 54 is described. As shown in FIG. 3, the controlling device 54 is provided with a system controller 100, formed by a microcomputer. The system controller 100 is connected to an operating section 104, represented by a keyboard or the like, for operation thereof. Further, the system controller 100 is connected to a mechanism section 138 which records an image on the light and heat sensitive recording material 12 in the image-recording system 10 of the present embodiment as described above.

The mechanism section 138 includes a conveying mechanism 128, an RGB exposing unit 130, a heat-developing head unit 132, a sensor unit 134, which includes various sensors and mode switches, and an optical fixing unit 136. The conveying mechanism 128 includes the pairs of conveying rollers 28 to 40 and a driving control section (not shown) for controlling the rollers. The RGB exposing unit 130 includes the optical recording section 16. The heat-developing head unit 132 includes the thermal recording head 50 and the platen roller 52. The sensor unit 134 includes the position-detecting sensors 56 to 62. The optical fixing unit 136 includes the optical fixing section 20. Since the conveying mechanism 128, the heat-developing head unit 132, the sensor unit 134 including the various sensors and mode switches, and the optical fixing unit 136 of the mechanism section 138 are controlled from a system side, they are respectively connected to the system controller 100 via a bus 144 so as to be able to send and receive data and commands.

The system controller 100 is further connected to a memory controller 102, which is formed by a microcomputer and controls image data. The memory controller 102 is connected via a bus 142 to an LCD controller 106, an image display LCD 108, a DAC 110, an SSFDC slot 112, a digital input interface (IF) 116, an ADC 118 and a print controller 120, so as to be able to send and receive data and commands. The LCD controller 106, the DAC 110, the SSFDC slot 112, the digital input IF 116, the ADC 118 and the print controller 120 are connected via a bus 140 to a RAM 114 which serves as an image memory for storing image data, so as to be able to send and receive image data and commands.

The image display LCD 108 includes a liquid crystal panel, which displays color images. The LCD controller 106 controls the image display LCD 108. The image display LCD 108 may be any display device, such as a CRT display. If the image display 108 is a CRT display, the LCD controller 106 will be a CRT controller. The DAC 110 is a converter for converting digital signals into analog signals. In the present embodiment, the DAC 110 converts digital image data into analog image data. The DAC 110 is connected to an image output terminal 122, which provides the image data to the outside of the system.

The SSFDC slot 112 is a controller that reads/writes image data from/to a storage medium such as a floppy disc or the like. Examples of the storage medium include discs such as CD-Rs, MDs, MOs, DVDs and the like, and magnetic tapes such as DATs. The storage medium loaded in the SSFDC slot 112A may store a process routine or the like, as described later.

The RAM 114 serves as an image memory, and is connected to a digital image input terminal 124 so as to enable input of image data from the outside of the system. The digital input IF 116 is used for sending and receiving digital signals, particularly commands. The ADC 118 is a converter for converting analog signals into digital signals. In the present embodiment, the ADC 118 converts analog image data into digital image data. The ADC 118 is connected to an analog image input terminal 126 so as to enable analog input of image data from the outside of the system. The print controller 120 controls output of image data for printing a color image. That is, the print controller 120 is connected to the RGB exposing unit 130, and outputs image data to be passed on to the RGB exposing unit 130.

In the image-recording system of the present embodiment having the above-described structure, the optical recording section 16 corresponds to an optical recording section of the present invention, the heat-developing section 18 corresponds to a heat-developing section of the present invention, and the controlling device 54 is at least a portion of a conveyance-controlling device of the present invention. Further, the accommodating section 14 corresponds to an accommodating section of the present invention, and the pair of conveying rollers 28 corresponds to a taking-out device of the present invention.

Figure 11A:
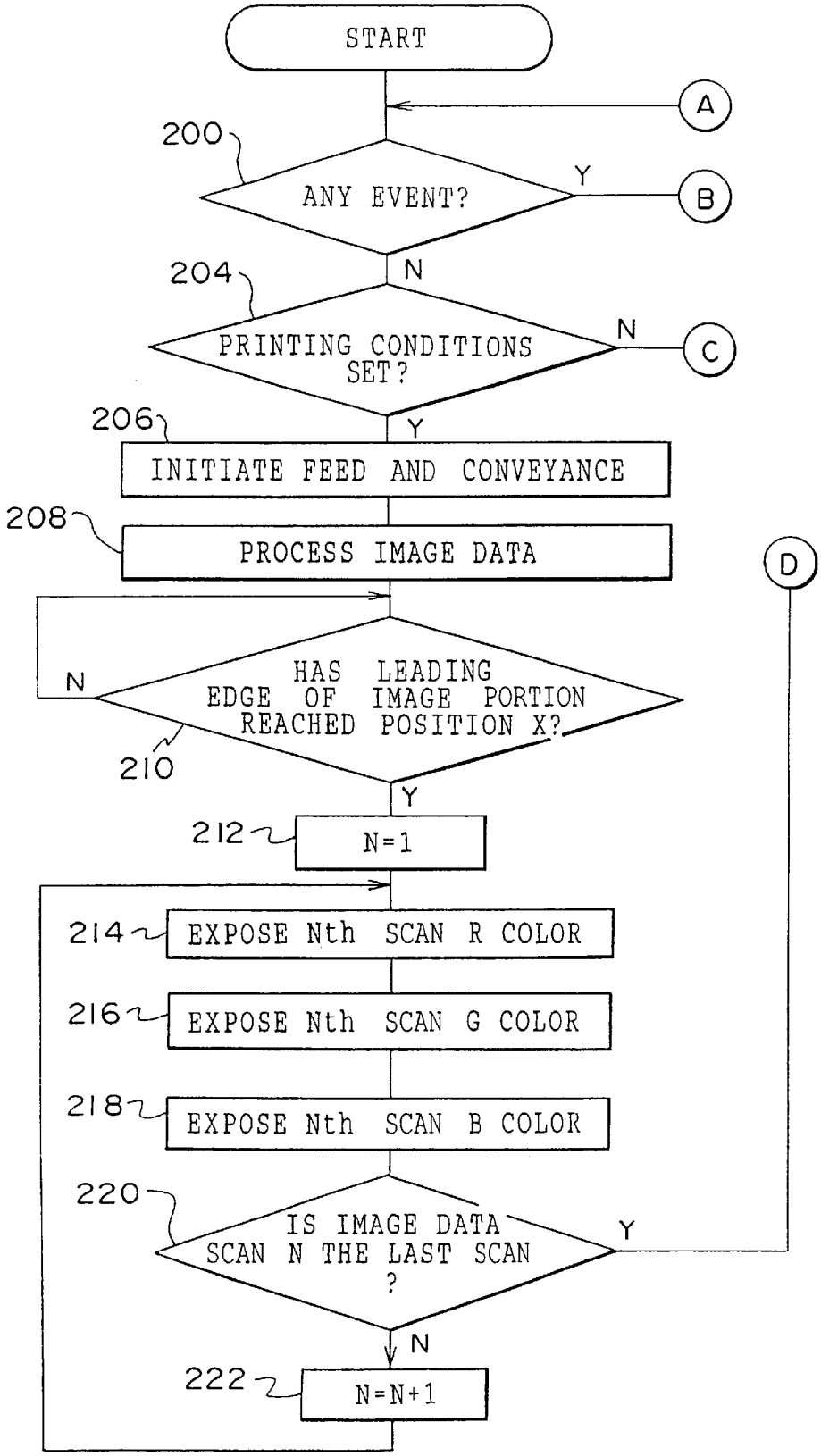
FIGS. 11A and 11B are flow charts illustrating processing flow for the image-recording system relating to the first embodiment of the present invention.
Figure 11B:
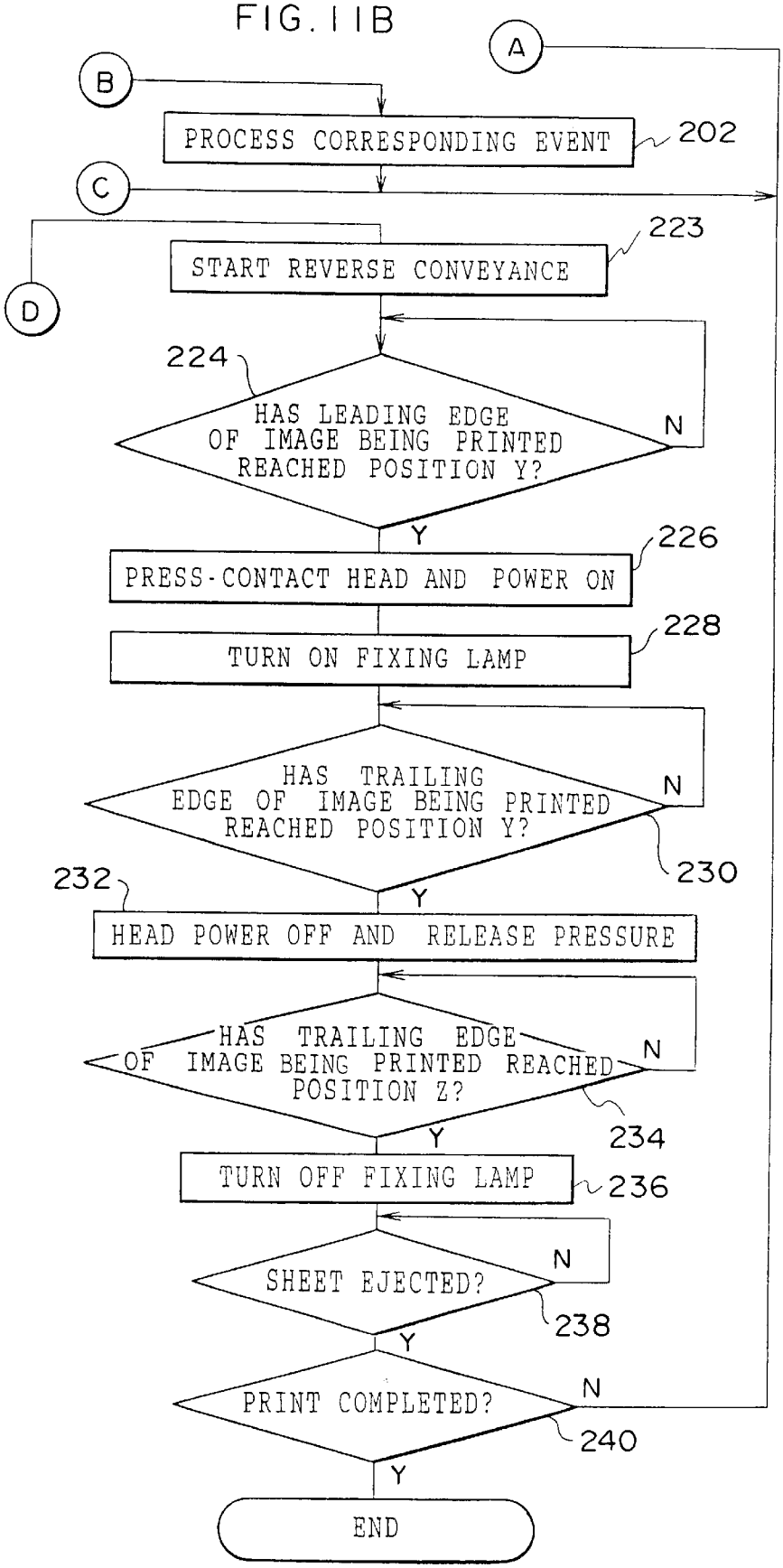

Next, operation of the image-recording system 10 of the present embodiment is described. When the image-recording system 10 is turned on, a processing routine shown in FIG. 11 is run at predetermined time intervals. First, in step 200, it is determined whether or not there is an event by detecting input status of the operating section 104. "Event" means an operation relating to image-recording, for example, operations in which settings relating to the system itself and settings relating to printing conditions are checked. Events corresponding to setting checks relating to the system itself include checking the life of the thermal recording head 50, checking the life of the fixing lamps, checking the life of the laser sources, checking the amount of paper remaining in the accommodating cassette, and the like. Events corresponding to setting checks relating to printing conditions include selecting the type of the light and heat sensitive recording material 12, selecting the number of sheets to be printed, ordering a print, ordering color correction at the time of printing, specifying size, instructing trimming, setting printing resolution, retrieving image data, outputting image data, and the like.

If the determination in step 200 is affirmative, the process proceeds to step 202, executes a process corresponding to the event, and returns to step 200. If the determination in step 200 is negative, the process proceeds to step 204 and determines whether fundamental printing conditions, such as the number of sheets to be printed, have been set or not. If the printing conditions have not yet been set, that is, if the determination in step 204 is negative, the process returns to step 200. If the printing conditions have been set, that is, if the determination in step 204 is affirmative, the process proceeds to step 206.

Figure 6:
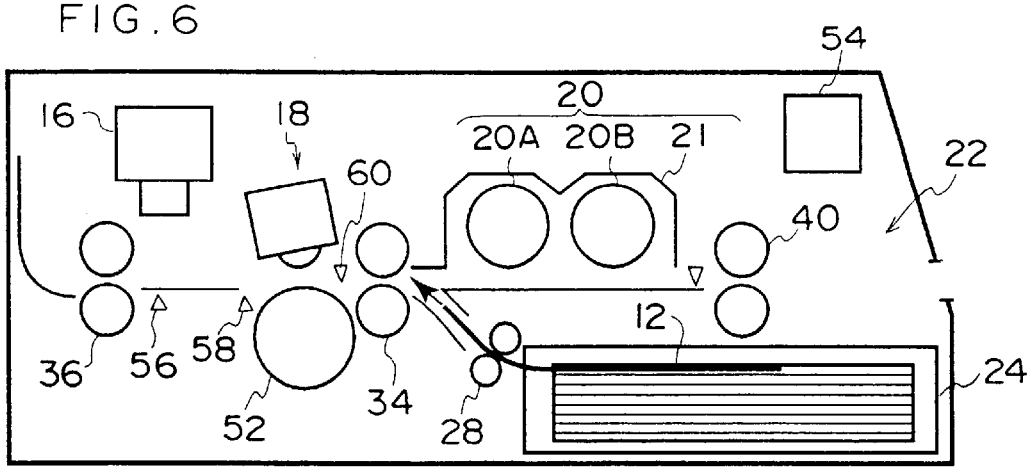
FIG. 6 is a schematic view showing flow of a light and heat sensitive recording material in the image-recording system relating to the first embodiment of the present invention, and showing initial conveyance of the light and heat sensitive recording material.

In step 206, a light and heat sensitive recording material 12 of a specified size is conveyed. That is, as shown in FIG. 6, the light and heat sensitive recording material 12 is taken out from the accommodating cassette 24 of the accommodating section 14 that accommodates the light and heat sensitive recording material 12 of the specified size, and conveyance toward the optical recording section 16 is commenced. In the next step 208, image data of an image to be printed is subjected to image processing at the controlling device 54, and the process proceeds to the next step 210.

In step 210, whether or not the leading edge of an image portion of the light and heat sensitive recording material 12 has reached the position X is determined on the basis of a detection value of the position-detecting sensor 56. This determination can be made by detecting the leading edge of the light and heat sensitive recording material 12 with the position-detecting sensor 56, and then judging when the light and heat sensitive recording material 12 has been conveyed a distance from the leading edge of the material to the image position at which the actual image is to be recorded. The determination in step 210 is repeated until the leading edge of the image portion reaches the position X.

Figure 7:
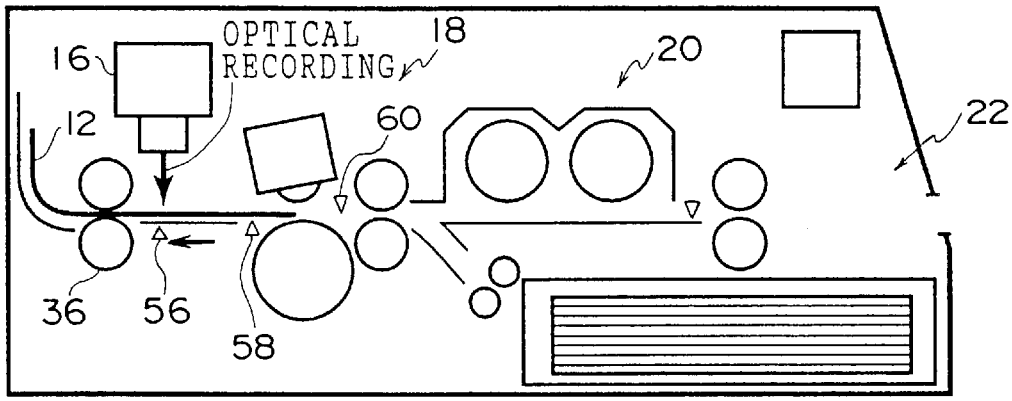
FIG. 7 is a schematic view showing the flow of the light and heat sensitive recording material in the image-recording system relating to the first embodiment of the present invention, and showing conveyance at a time of optical recording.

When the leading edge of the image portion has reached the position X, an affirmative determination is made in step 210, and a variable N, which indicates an image exposure scan count, is set to an initial value in step 212 (N=1). Then, the Nth exposure for R color is carried out in step 214, the Nth exposure for G color is carried out in step 216, and the Nth exposure for B color is carried out in step 218. That is, in steps 214–218, the image data which has been subjected to image processing is retrieved from the RAM 114 which serves as the image memory, and the light and heat sensitive recording material 12 is exposed with the laser beams from the RGB laser sources on the basis of the retrieved image data, as shown in FIG. 7. Thus, the main-scanning is effected by the polygon mirror and the sub-scanning is effected by the conveyance of the light and heat sensitive recording material 12.

In the next step 220, whether or not the exposure scan that has just been performed is the last scan, that is, the trailing edge of the image, is determined. If the determination in step 220 is negative, there still remains more exposure to be carried out. Accordingly, the variable N is incremented in the next step 222, the process returns to step 214, and the exposure process is repeated. If the determination in step 220 is affirmative, the process proceeds to step 223. In step 223, the pairs of conveying rollers 34 and 36 are rotated in the reverse direction so as to convey the light and heat sensitive recording material 12 in the opposite direction (switchback).

In the next step 224, whether or not the leading edge of the image being printed has reached the position Y or not is determined on the basis of detection values from the position-detecting sensors 58 and 60. This determination can be made by detecting the leading edge of the light and heat sensitive recording material 12 with the position-detecting sensor 58, or with the position-detecting sensors 58 and 60, and then judging when the leading edge of the actual image being printed has been conveyed to the position Y, where heat-development is to be carried out. The determination in step 224 is repeated until the leading edge of the image being printed reaches the position Y.

Figure 8:
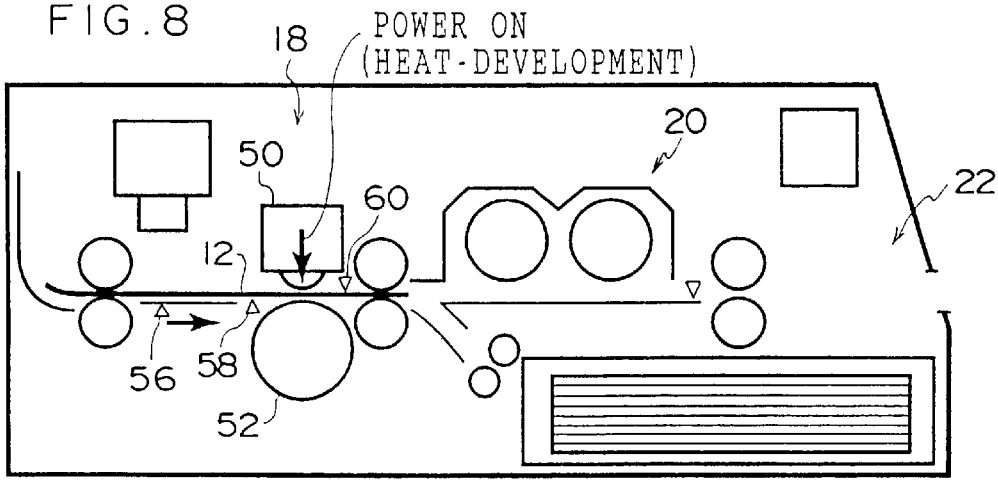
FIG. 8 is a schematic view showing the flow of the light and heat sensitive recording material in the image-recording system relating to the first embodiment of the present invention, and showing conveyance at a time of heat-development.

When the leading edge of the image being printed has reached the position Y, an affirmative determination is made in step 224. Then, in step 226, the thermal recording head 50 and the platen roller 52 are brought into pressing-contact, and a supply of electricity to the thermal recording head 50 is turned on. Thus, as shown in FIG. 8, heat-development is commenced. In the heat-development, the light and heat sensitive recording material 12 is heated by the thermal recording head 50 from the light and heat sensitive recording layer side (exposed surface side). Therefore, thermal conduction efficiency is good. At the time of heating by the thermal recording head 50, thermal energy supplied to the light and heat sensitive recording material 12 is controlled by the controlling device 54, which controls such that the temperature of the light and heat sensitive recording layer of the light and heat sensitive recording material 12 (and thus thermal energy) is within a predetermined desired temperature range. This applied energy (heating energy) is controlled to be within a range of 20 to 200 mJ/mm$^2$, or more specifically within a range from (120° C.×1 msec.) to (250° C.×500 msec).

The thermal recording head 50 consists of a plurality of heating elements, and the plurality of heating elements can be respectively controlled. Therefore, temperature distribution over the thermal recording head 50 consisting of the plurality of heating elements can be made homogeneous or biased.

Figure 9:
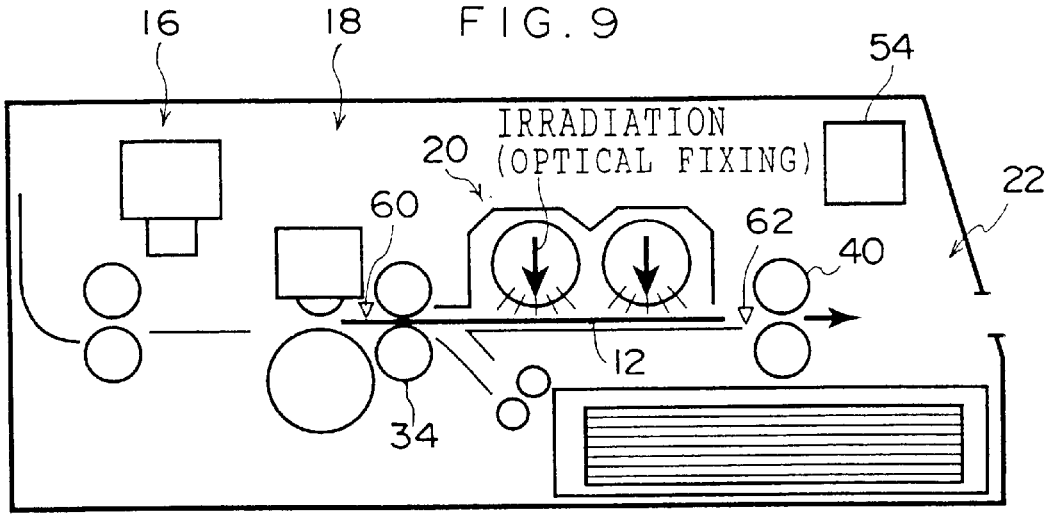
FIG. 9 is a schematic view showing the flow of the light and heat sensitive recording material in the image-recording system relating to the first embodiment of the present invention, and showing conveyance at a time of optical fixing.

In the next step 228, the fixing lamp is turned on and the heat-developed image on the light and heat sensitive recording material 12, which is being conveyed through the optical fixing section 20, is fixed, as shown in FIG. 9. In the next step 230, whether or not the trailing edge of the image being printed has reached the position Y or not is determined on the basis of the detection values from the position-detecting sensors 58 and 60. This determination can be made by detecting the trailing edge of the light and heat sensitive recording material 12 with the position-detecting sensor 58 or the position-detecting sensors 58 and 60, and judging when the trailing edge of the actual printed image has been conveyed to the position Y. The determination in step 230 is repeated until the trailing edge of the printed image reaches the position Y.

When the trailing edge of the printed image has reached the position Y, an affirmative determination is made in step 230, and the thermal recording head 50 and the platen roller 52 are spaced apart from each other in step 232. Thus, the pressure from the thermal recording head 50 onto the light and heat sensitive recording material 12 is released. In the next step 234, whether or not the trailing edge of the printed image has reached the position Z or not is determined on the basis of a detection value from the position-detecting sensor 62. This determination can be made by detecting the trailing edge of the light and heat sensitive recording material 12 with the position-detecting sensor 62, and judging when the trailing edge of the actual printed image has been conveyed to the position Z. The determination in step 234 is repeated until the trailing edge of the printed image reaches the position Z.

Figure 10:
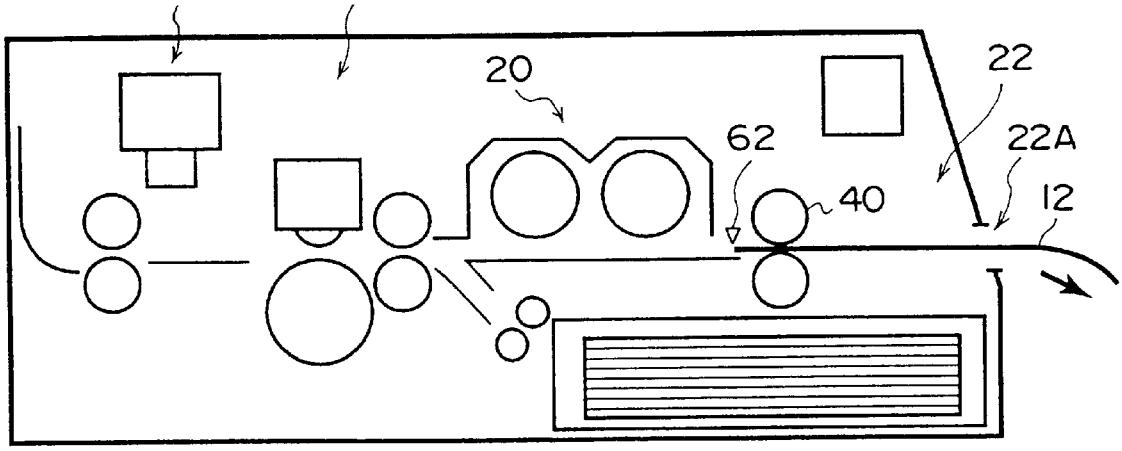
FIG. 10 is a schematic view showing the flow of the light and heat sensitive recording material in the image-recording system relating to the first embodiment of the present invention, and showing conveyance at a time of ejection.

When the trailing edge of the printed image has reached the position Z, an affirmative determination is made in step 234, and, because optical fixing is not necessary at this time, the fixing lamp is turned off in step 236, as shown in FIG. 10. In the next step 238, whether or not the sheet has been ejected is determined. This determination may be made on the basis of a detection value from a sensor provided at the ejection port 22A, or an affirmative determination may be made on the basis of the detection values from the position-detecting sensor 62 when a predetermined time has passed. When the sheet has been ejected, an affirmative determination is made in step 238. In the next step 240, whether or not printing has been completed is determined by determining whether or not printing onto the number of sheets specified in the printing conditions has been completed or not. If there still remains more printing to be carried out, a negative determination is made in step 240 and the process returns to step 200 to repeat the above-described process. If the printing has been completed, the process routine ends.

As described above, in the present embodiment, the optical recording is carried out while the light and heat sensitive recording material 12 is conveyed in one direction, and the heat-development is carried out while the light and heat sensitive recording material 12 is conveyed in the reverse direction on the same conveying path. Because an image can be recorded by just conveying the light and heat sensitive recording material 12 forward and backward along the conveying path, the sections for respective processes can be overlapped and the system can be made compact. Further, since the light and heat sensitive recording material 12 is recorded with a latent image in the forward direction and heat-developed in the backward direction, conveyance for the latent image-recording and the heat-development can be dissociated. Therefore, even if there is a difference between the conveying speeds of the different processes, they are not affected by each other, and the conveying speed for each process can be stabilized.

Second Embodiment

In the above-described embodiment, the thermal recording head 50 records an image onto the light and heat sensitive recording material 12 which has been cut to a predetermined size. In the present embodiment, the thermal recording head 50 records an image onto a long belt form of the light and heat sensitive recording material 12. Since the present embodiment has substantially the same structure as that of the above-described embodiment, like parts are designated with like reference numerals, and detailed descriptions thereof are omitted.

Figure 12:
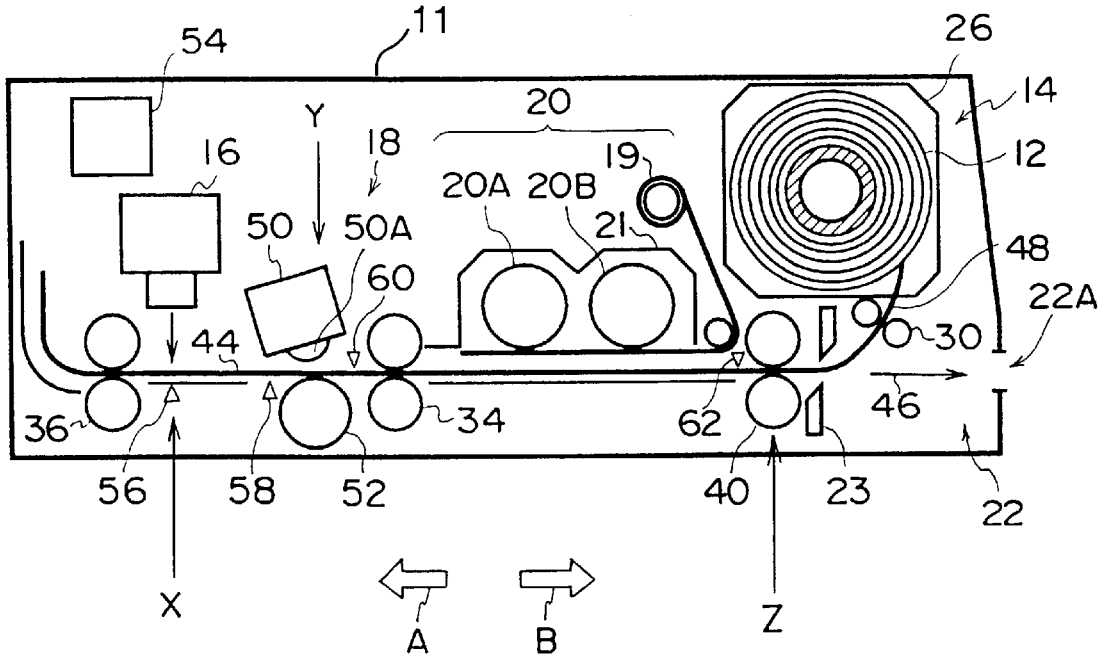
FIG. 12 is a schematic view showing a schematic structure of an image-recording system relating to a second embodiment of the present invention.

FIG. 12 shows a schematic internal structure of the image-recording system 10 of the present embodiment. As shown in FIG. 12, the accommodating section 14, which accommodates the long light and heat sensitive recording material 12, is contained in the body 11 of the image-recording system 10. In the present embodiment, the accommodating section 14 is provided at an upper portion of the body 11 of the image-recording system 10, and the light and heat sensitive recording material 12 is accommodated in an accommodating cassette 26. A plurality of accommodating cassettes may be provided in order to accommodate different widths of the light and heat sensitive recording material 12 (e.g., A4 and A6 widths) or light and heat sensitive recording materials of the same size. A pair of conveying rollers 30 that nip and convey the light and heat sensitive recording material 12 are disposed at the light and heat sensitive recording material 12 output side of the accommodating cassette 26 of the accommodating section 14.

Pairs of conveying rollers 34, 36 and 40 which can rotate in forward and reverse directions (bidirectionally) are provided downstream side from the pair of conveying rollers 30 in a conveying direction (the direction of arrow A in FIG. 12). Along the conveying direction (the direction of arrow A in FIG. 12), the optical fixing section 20 is provided between the pairs of conveying rollers 40 and 34, and the heat-developing section 18 and the optical recording section 16 are provided between the pairs of conveying rollers 34 and 36.

A conveying path 48 is formed for conveyance of the light and heat sensitive recording material 12 by the pair of conveying rollers 30 from the accommodating cassette 26 of the accommodating section 14 toward the pair of conveying rollers 40 (in the direction of arrow A in FIG. 12, the conveying direction). A cutting device 23, which cuts the light and heat sensitive recording material 12, is provided on the conveying path 48. The light and heat sensitive recording material 12 which has been pulled out from the accommodating cassette 26 is cut to a predetermined length by the cutting device 23.

Further, a conveying path 44 is formed for bidirectional conveyance of the light and heat sensitive recording material 12 through the optical recording section 16, the heat-developing section 18 and the optical fixing section 20 by the pairs of conveying rollers 34, 36 and 40 (in the direction of arrow A, the conveying direction, and in the direction of arrow B, the direction opposite to the conveying direction, in FIG. 12). Furthermore, a conveying path 46 is formed for ejection by the pair of conveying rollers 40 of the light and heat sensitive recording material 12 which has passed through the heat-developing section 18. Thus, the light and heat sensitive recording material 12 accommodated in the accommodating cassette 26 is conveyed from the accommodating section 14 through the optical fixing section 20 and the heat-developing section 18 to the optical recording section 16 and, after recording, is switched back through the heat-developing section 18, the optical fixing section 20 and the ejecting section 22 to be ejected to the outside of the body 11 of the image-recording system 10.

The light and heat sensitive recording material 12 is conveyed from the conveying path 48 to the conveying path 44, and then is conveyed backward on the conveying path 44 toward the conveying path 46. The light and heat sensitive recording material 12 to be conveyed backward must be assuredly conveyed from the pair of conveying rollers 40 to the pair of conveying rollers 40 belonging to the ejecting section 22, so that the light and heat sensitive recording material 12 does not go back into the accommodating section 14. To this end, as in the above-described embodiment (see FIGS. 4 and 5), a switching member that switches between the conveying path 48 and the conveying path 46, when the light and heat sensitive recording material 12 is conveyed in the conveying direction (the direction of arrow A in FIG. 12) and when it is conveyed in the direction opposite to the conveying direction (the direction of arrow B in FIG. 12), is preferably provided. That is, when a leading edge of the light and heat sensitive recording material 12 is pulled out from the accommodating cassette 26 and is conveyed on the conveying path 42 in the conveying direction (the direction of arrow A in FIG. 12), conveying path 48 is opened, and the light and heat sensitive recording material 12 proceeds toward the pair of conveying rollers 40. When the light and heat sensitive recording material 12 is conveyed on the conveying path 44 in the direction opposite to the conveying direction (the direction of arrow B in FIG. 12), the conveying path 48 is closed and the light and heat sensitive recording material 12 proceeds toward the ejection port 22A.

The pairs of conveying rollers 30, 34, 36 and 40 are connected to a conveyance driving section (not shown), and are respectively driven by the unillustrated conveyance driving section.

In the structure of the present embodiment, before optical recording, the unexposed light and heat sensitive recording material 12 passes through the optical fixing section 20. Therefore, a fixing shutter 19 is provided at the optical fixing section 20. The fixing shutter 19 is structured such that a sheet-like light-shielding member thereof can be rolled up and drawn out. When the sheet-like light-shielding member is rolled up, the optical fixing section 20 is open and light is irradiated from fixing lamps 20A and 20B. When the sheet-like light-shielding member is drawn out, the optical fixing section 20 is closed and irradiation from the fixing lamps 20A and 20B is shielded.

In the image-recording system of the present embodiment having the above-described structure, the accommodating cassette 26 corresponds to an accommodating section of the present invention, the pair of conveying rollers 30 corresponds to a taking-out device of the present invention, and the cutting device 23 corresponds to a cutting device of the present invention.

Figure 18A:
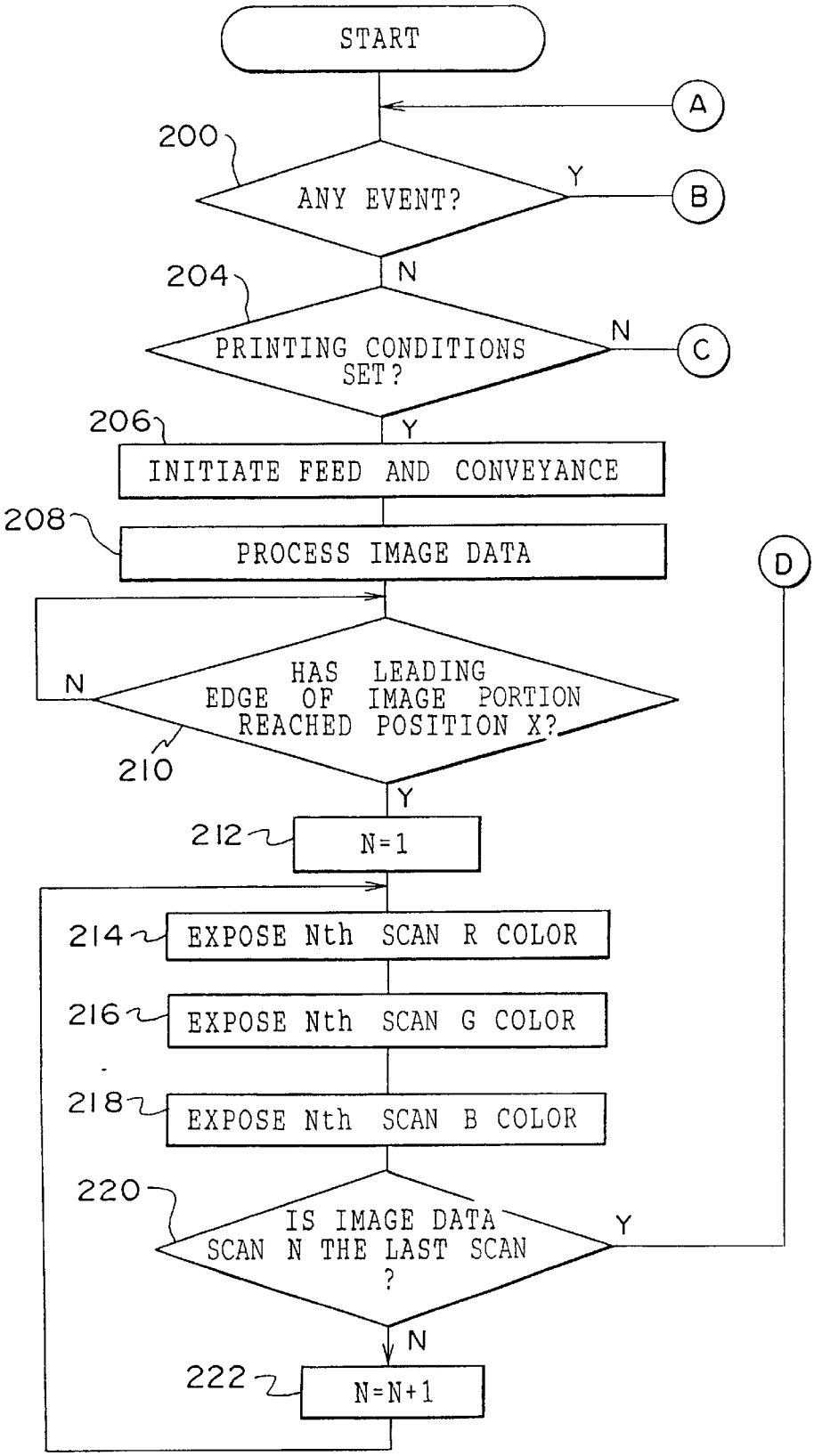
FIGS. 18A and 18B are flow charts illustrating processing flow for the image-recording system relating to the second embodiment of the present invention.
Figure 18B:
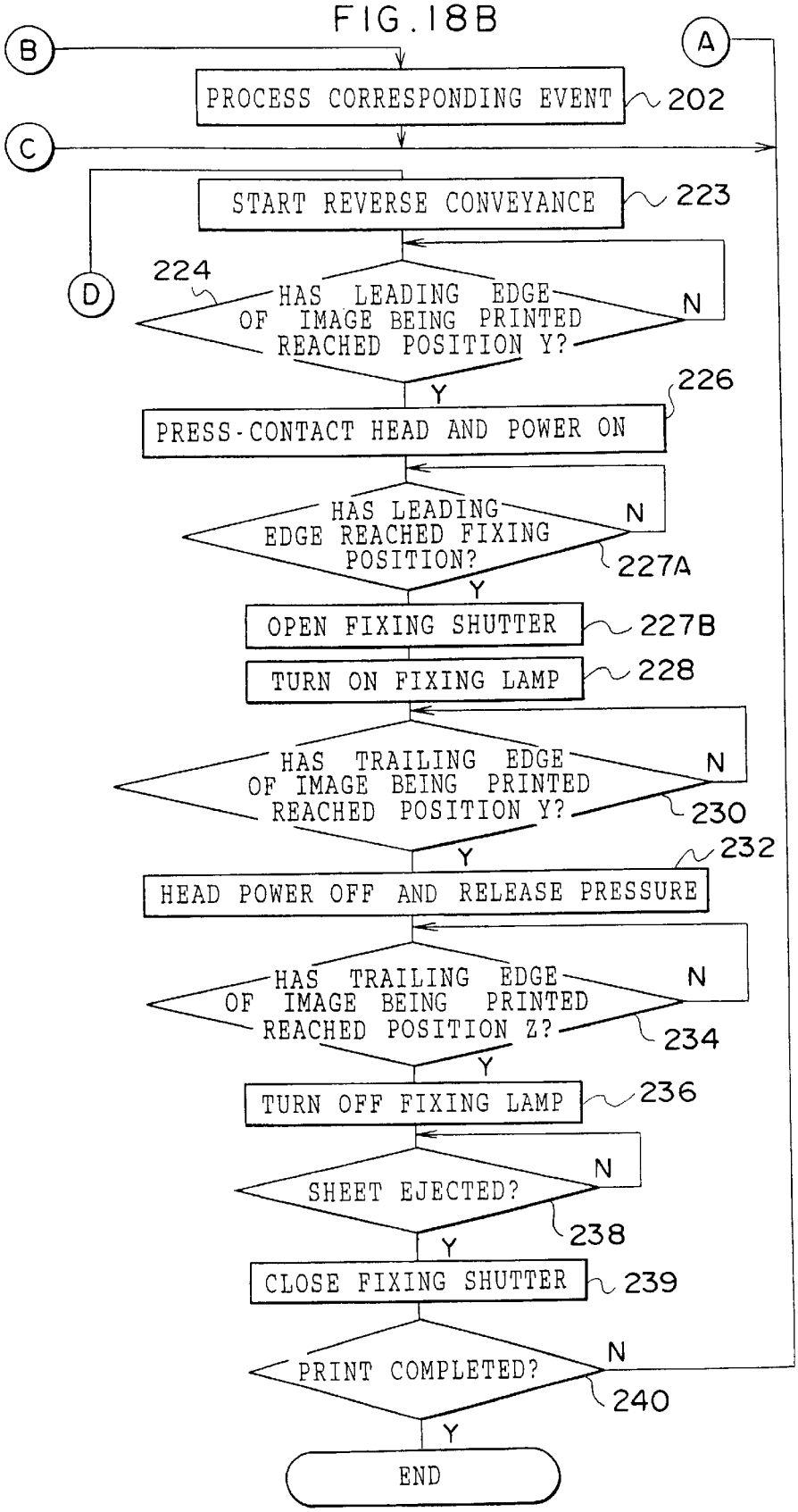

Next, operation of the image-recording system 10 of the present embodiment is described. When the image-recording system 10 is turned on, a process routine shown in FIG. 18 is run at predetermined time intervals. In the initial state of this process routine, the sheet-like shielding member of the fixing shutter 19 described above is drawn out to close the optical fixing section 20 and shield light irradiation from the fixing lamps 20A and 20B. Since the process routine shown in FIG. 18 is similar to the above-described process routine shown in FIG. 11, descriptions of like portions are omitted or summarized, and only portions that are different from the process routine of FIG. 11 are described in detail.

Figure 13:
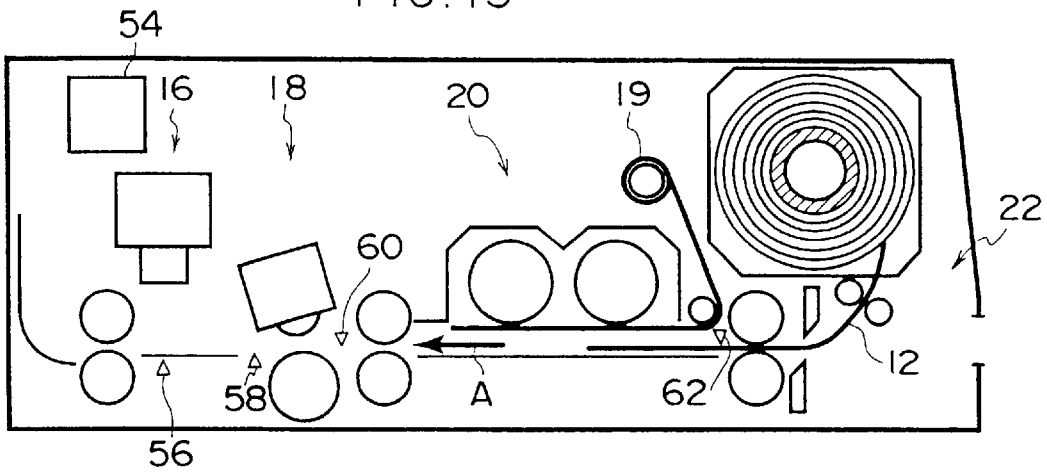
FIG. 13 is a schematic view showing flow of a light and heat sensitive recording material in the image-recording system relating to the second embodiment of the present invention, and showing initial conveyance of the light and heat sensitive recording material.
Figure 14:
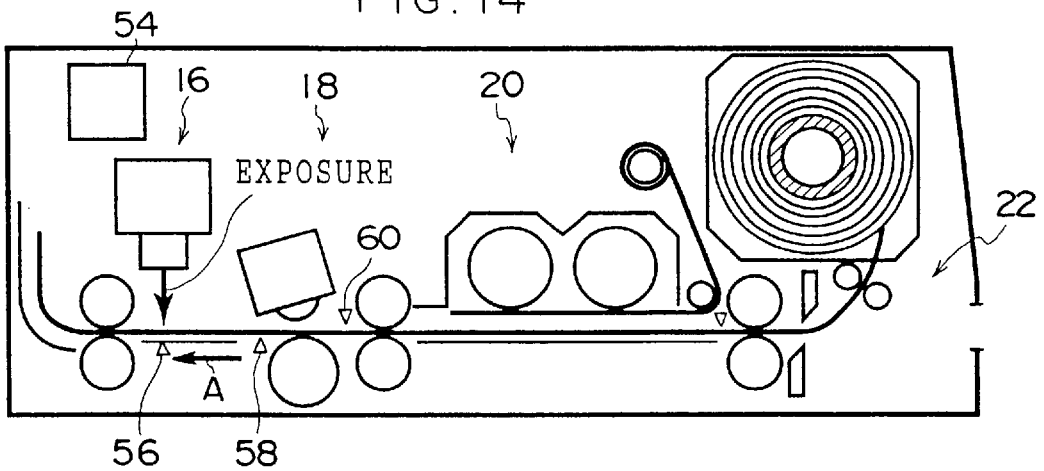
FIG. 14 is a schematic view showing the flow of the light and heat sensitive recording material in the image-recording system relating to the second embodiment of the present invention, and showing conveyance at a time of optical recording.

When any event processes have been completed and printing conditions have been set, conveyance of the light and heat sensitive recording material 12 is commenced (steps 200 through 206). That is, as shown in FIG. 13, the roll-like light and heat sensitive recording material 12 is taken out from the accommodating cassette 26 of the accommodating section 14 and is conveyed toward the optical recording section 16. Then, image data processing is carried out on image data of an image to be printed (step 208), and exposures for R, G and B colors are carried out from an image portion position on the light and heat sensitive recording material 12, on the basis of detection values from the position-detecting sensor 56 (steps 210 to 222). That is, the processed image data is retrieved from the RAM 114 which serves as an image memory, and the light and heat sensitive recording material 12 is exposed with laser beams from the RGB laser sources on the basis of the retrieved image data, as shown in FIG. 14. The main-scanning is effected by the polygon mirror and the subscanning is effected by the conveyance of the light and heat sensitive recording material 12.

Figure 15:
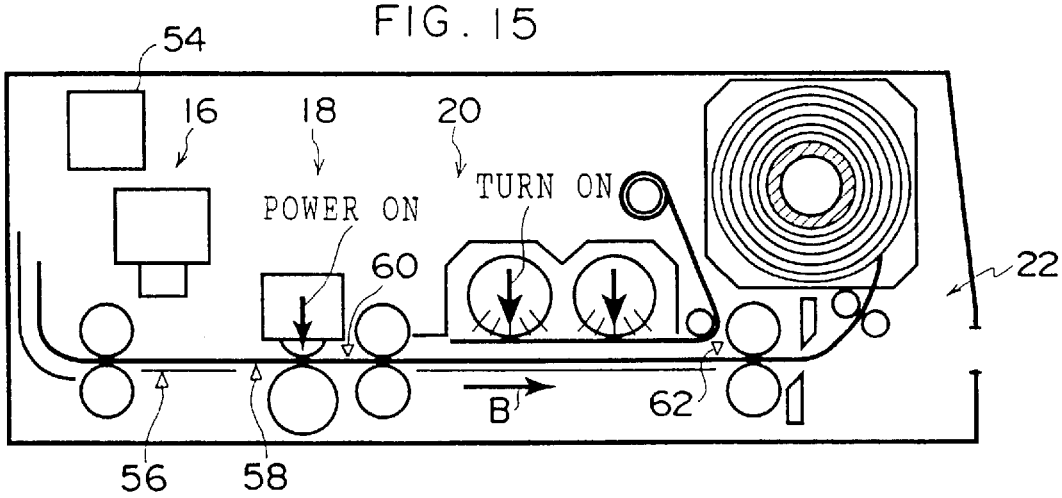
FIG. 15 is a schematic view showing the flow of the light and heat sensitive recording material in the image-recording system relating to the second embodiment of the present invention, and showing conveyance at a time of heat-development.

When the exposure has been completed, the pairs of conveying rollers 34 and 36 are rotated in reverse, to convey the light and heat sensitive recording material 12 in the reverse direction (switchback). When the leading edge of the image being printed has, on the basis of detection values from the position-detecting sensors 58 and 60, reached the position Y where heating-development is carried out the thermal recording head 50 and the platen roller 52 are brought into pressing-contact and electricity to the thermal recording head 50 is turned on (steps 223 the 226). Then, when the leading edge of the image being printed has reached a position where optical fixing is carried out, on the basis of detection values from the position-detecting sensors 58 and 60, (an affirmative determination in step 227A), the fixing shutter 19 is opened (step 227B) and the fixing lamps are turned on (step 228). Thus, heat-development is started, as shown in FIG. 15, and the heat-developed image on the light and heat sensitive recording material 12 is conveyed through the optical fixing section 20 and fixed.

Figure 16:
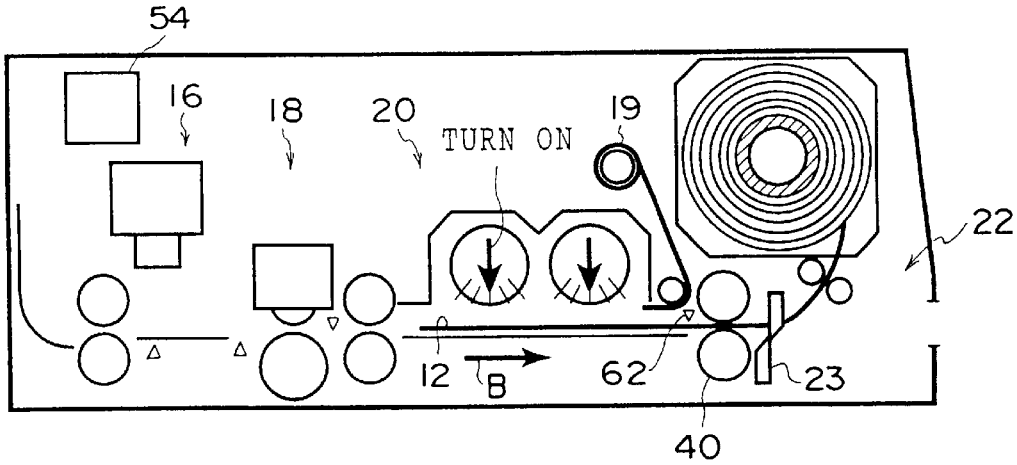
FIG. 16 is a schematic view showing the flow of the light and heat sensitive recording material in the image-recording system relating to the second embodiment of the present invention, and showing conveyance at a time of optical fixing.

Then, when the trailing edge of the printed image has reached the position Y, on the basis of detection values from the position-detecting sensors 58 and 60, the electricity to the thermal recording head 50 is turned off, as shown in FIG. 16, and the thermal recording head 50 and the platen roller 52 are spaced apart from each other (steps 230 and 232). Thus, application of thermal energy by the thermal recording head 50 is ended, and pressure from the thermal recording head 50 onto the light and heat sensitive recording material 12 is released. At this time, the cutting device 23 cuts the light and heat sensitive recording material 12 to a predetermined length.

Figure 17:
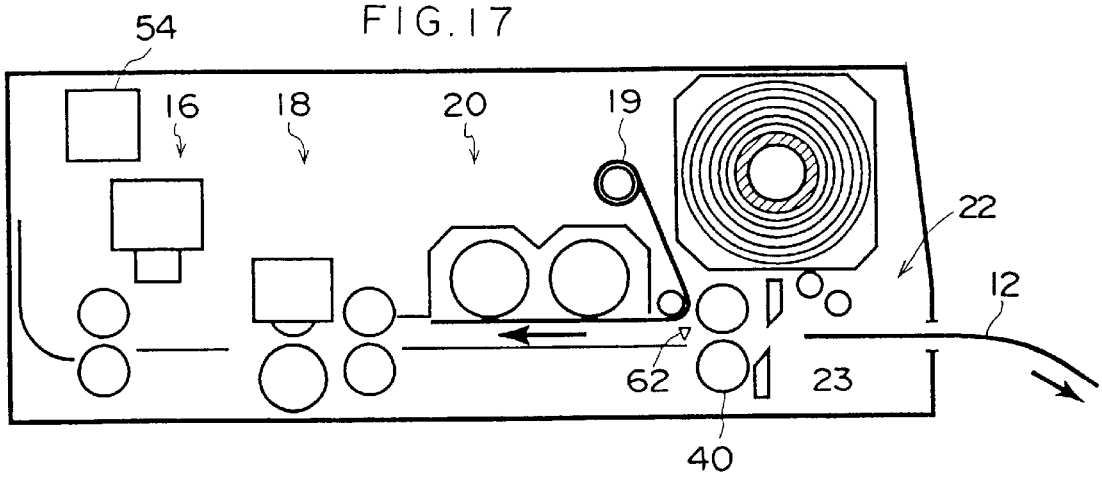
FIG. 17 is a schematic view showing the flow of the light and heat sensitive recording material in the image-recording system relating to the second embodiment of the present invention, and showing conveyance at a time of ejection.

When the trailing edge of the printed image has, on the basis of detection values from the position-detecting sensor 62, reached the position Z (step 234), because optical fixing is not necessary at this time, the fixing lamps are turned off as shown in FIG. 17 (step 236). When the sheet has been fed out (step 238), the fixing shutter 19 is closed, that is, the sheet-like shielding member thereof is drawn out so as to close the optical fixing section 20 (step 239). When the ejection of the sheet has been completed, the above-described process is repeated until printing onto the number of sheets specified in the printing conditions has been completed (step 240).

As described above, in the present embodiment, the optical recording is carried out while the light and heat sensitive recording material 12 is being conveyed in one direction, and the heat-development is carried out while the light and heat sensitive recording material 12 is being conveyed in the reverse direction along the same conveying path. Thus, since an image can be recorded by just conveying the light and heat sensitive recording material 12 forward and backward on the conveying path, the sections for respective processes can be overlapped and the system can be made compact.

Further, since the light and heat sensitive recording material 12 is recorded with a latent image in the forward direction and heat-developed in the backward direction, conveyance for the latent image-recording and the heat-development can be dissociated. Therefore, even if there is a difference between the conveying speeds of the respective processes, they are not affected by each other, and a conveying speed for each process can be stabilized. In addition, the long light and heat sensitive recording material 12 can, as necessary, be reciprocated along the conveying path and can be cut to a size corresponding to an imaging portion that has been subjected to optical recording, heat-development and optical fixing.

In the above-described embodiments, the heat-developing section 18 and the optical recording section 16 are provided in that order along the conveying direction at the time of optical recording (in the direction of arrow A in FIGS. 1 and 12). This arrangement may be reversed, and the heat-developing section 18 and the optical recording section 16 are preferably positioned with consideration to nipping of the light and heat sensitive recording material 12 by the pairs of conveying rollers.

Further, although a light beam scanning device provided with laser sources is used for the optical recording section in the above-described embodiments, aperture-controlled light from a lamp, an LED or the like may be used for exposure, or exposure may be carried out by projecting an image with a lamp or the like. Contact exposure may also be used.

Furthermore, although the light source for fixing is separately provided from the light source for recording at the optical recording section in the above-described embodiments, optical fixing may be performed by scanning-exposure with light that has the same wavelength as the recording light, using the light beam scanning device of the optical recording section, which is provided with laser sources.

In addition, although the thermal recording head is used as the heating device in the above-described embodiments, a far-infrared heater provided with a glazed portion may be used for applying thermal energy.

Further, in the present invention, when a long form of the light and heat sensitive recording material 12 is used, an unexposed portion of the light and heat sensitive recording material 12 passes through the optical fixing section 20. However, this is not intended to limit the present invention, and the light and heat sensitive recording material 12 may be drawn out at a position between the heat-developing section 18 and the optical fixing section 20. In this case, the cutting device can be provided downstream.

Light and heat sensitive Recording Material

Next, a light and heat sensitive recording material, which is used for image-recording in the image-recording device of the present invention, will be described. The light and heat sensitive recording material used in the present invention has a light and heat sensitive layer (an image-recording layer) on a support. At this light and heat sensitive layer, a latent image is formed by exposure. The latent image is developed by being heated, so that an image is formed. In the light and heat sensitive recording material used in the present invention, other than the light and heat sensitive recording layer, conventionally known other layers such as a protection layer, an intermediate layer, a UV absorbing layer and the like may be formed at any position. The light and heat sensitive recording material used in the present invention may have, on the support, at least three light and heat sensitive recording layers, which include a yellow color-forming component, a magenta color-forming component and a cyan color-forming component, respectively. Thus, the material can be used for color image formation as a color light and heat sensitive recording material. This color light and heat sensitive recording material may include a light and heat sensitive recording layer that includes a black color-forming component, if required.

In the present invention, a light and heat sensitive recording material which includes a light and heat sensitive recording layer (a), (b), (c) or (d) can be appropriately used. A light and heat sensitive layer (a) contains 1) thermally-responsive microcapsules which encapsulate a color-forming component A and, outside the microcapsules, 2) a photo-polymerizable composition which contains at least i) a compound B which is substantially colorless and has, within the same molecule, a polymerizable group and a site which reacts with the color-forming component A to form color, and ii) a photoinitiator. A light and heat sensitive recording layer (b) contains 1) thermally-responsive microcapsules which encapsulate a color-forming component A and, outside the microcapsules, 2) a photo-polymerizable composition which contains at least i) a substantially colorless compound C which reacts with the color-forming component A to form color, ii) a photo-polymerizable compound D and iii) a photoinitiator. A light and heat sensitive recording layer (c) contains 1) thermally-responsive microcapsules which encapsulate a color-forming component A and, outside the microcapsules, 2) a photo-polymerizable composition which includes at least i) a substantially colorless compound C which reacts with the color-forming component A to form color, ii) a photo-polymerizable compound Dp which has a site that suppresses the reaction of the color-forming component A with the compound C, and iii) a photoinitiator. A light and heat sensitive recording layer (d) contains 1) thermally-responsive microcapsules which encapsulate a substantially colorless compound C which reacts with a color-forming component A to form color and, outside the microcapsules, 2) a photo-polymerizable composition which contains at least i) the color-forming component A, ii) a photo-polymerizable compound D and iii) a photoinitiator.

In the light and heat sensitive recording layer (a), by carrying out exposure of a desired image shape, the photo-polymerizable composition outside the microcapsules polymerizes and is cured by radicals generated from the photo-initiator so that a latent image of the desired image shape is formed. Then, due to heating, the compound B present in an unexposed portion moves within the recording material, and reacts with the color-forming component A within the capsules, thereby forming color. Accordingly, the above-described light and heat sensitive recording layer (a) is a positive light and heat sensitive recording layer in which colors are not formed at an exposed portion, and uncured portions in the unexposed portion form color so that an image is formed. Specific examples thereof include a light and heat sensitive recording layer disclosed in Japanese Patent Application Laid-Open (JP-A) No. 3-87827, which contains, outside microcapsules, a photo-curable composition that contains a compound having, within the same molecule, an electron-accepting group and a polymerizable group and that has a photoinitiator, and which includes an electron-donating colorless dye which is encapsulated in the microcapsules. In this light and heat sensitive recording layer, by carrying out exposure, the photo-curable composition present outside the microcapsules polymerizes and is cured so that a latent image is formed. Thereafter, due to heating, the electron-accepting compound present in unexposed portions moves within the recording material and reacts with the electron-donating colorless dye within the microcapsules so as to form color. Accordingly, the cured latent image portions in the exposed portions do not form color and only the uncured portions form color, so that a sharp positive image having high contrast can be formed.

In the above-described light and heat sensitive recording layer (b), by effecting exposure to the desired image shape, the photo-polymerizable compound D is polymerized by radicals generated from the photoinitiator, which begins a reaction when exposed, and the film is cured so that a latent image of the desired image shape is formed. Because the photo-polymerizable compound D does not have a site for suppressing the reaction of the color-forming component A with the compound C, the compound C present in the unexposed portion moves within the recording material due to heating, and reacts with the color-forming component A within the capsules so as to form color. Thus, the above-described light and heat sensitive recording layer (b) is a positive light and heat sensitive recording layer in which color is not formed at the exposed portions and color is formed at the uncured portions in the unexposed portion, so that an image is formed. Specific examples of such a light and heat sensitive recording layer include a light and heat sensitive recording layer which contains an azomethine dye precursor encapsulated in microcapsules, a deprotective agent which generates an azomethine dye from the dye precursor, a photo-polymerizable compound and a photo-initiator. In this light and heat sensitive recording layer, by effecting exposure, the photo-polymerizable compound outside the microcapsules is polymerized and cured, and a latent image is formed. Then, the deprotective agent present in the unexposed portion is moved within the recording material by heating, and reacts with the azomethine dye precursor within the microcapsules so as to form color. Accordingly, the cured latent image portion of the exposed portion does not form color and only the uncured portions form color, so that a positive image can be formed.

In the light and heat sensitive recording layer (c), by carrying out exposure to the desired image shape, the photo-polymerizable compound Dp is polymerized by radicals generated from the photoinitiator, which begins a reaction when exposed, and the film is cured so that a latent image of the desired image shape is formed. Since the photo-polymerizable compound Dp has a site for suppressing the reaction of the color-forming component A with the compound C, the compound C moves depending on the film characteristic of the latent image (the cured portion) formed by exposure, and reacts with the color-forming component A in the capsules to form the image. Thus, the above-described light and heat sensitive recording layer (c) is a negative light and heat sensitive recording layer, in which the exposed portion forms color so that an image is formed. Specific examples of such a light and heat sensitive recording layer include a light and heat sensitive recording layer disclosed in JP-A No. 4-211252 which contains, outside microcapsules, an electron-accepting compound, a polymerizable vinyl monomer and a photoinitiator and, encapsulated in the microcapsules, an electron-donating colorless dye. The mechanism for image formation in this light and heat sensitive recording layer is unclear but is thought to be as follows. The vinyl monomer which exists outside the microcapsules is polymerized by exposure. Meanwhile, the electron-accepting compound present at the exposed portion is not included in the formed polymer at all. Instead, the interaction of the electron-accepting compound with the vinyl monomer decreases, so that the electron-accepting compound exists in a movable state with high diffusion speed. The electron-accepting compound in the unexposed portion is trapped by the vinyl monomer in the unexposed portion. Thus, under heating, the electron-accepting compound in the exposed portion moves preferentially within the recording material, and reacts with the electron-donating colorless dye within the microcapsules. The electron-accepting compound in the unexposed portion cannot penetrate the capsule walls, even when heated, and does not react with the electron-donating colorless dye, so cannot contribute to color formation. Accordingly, in the light and heat sensitive recording layer, since the image is formed such that the exposed portion thereof forms color and the unexposed portion thereof does not form color, a sharp negative image with high contrast can be formed.

In the above-described light and heat sensitive recording layer (d), by carrying out exposure to the desired image shape, the photo-polymerizable compound D is polymerized by radicals generated from the photoinitiator, which begins reaction due to exposure, and the film is cured, so that a latent image of the desired image shape is formed. Since the photo-polymerizable compound D does not have a site for suppressing the reaction of the color-forming component A with the compound C, the color-forming component A present at the unexposed portion moves within the recording material when heated, and reacts with the compound C within the capsules so as to form color. Accordingly, the above-described light and heat sensitive recording layer (d) is a positive light and heat sensitive recording layer in which color is not formed at the exposed portion and color is formed at the uncured portions of the unexposed portion, so that an image is formed.

Components which form the above-described light and heat sensitive recording layers (a) through (d) will be described hereinafter. As the color-forming component A in the light and heat sensitive recording layers (a) through (d), a substantially colorless electro-donating colorless dye or a diazonium salt compound may be used. Examples of the electron-donating colorless dye are disclosed from paragraph [0051] to paragraph [0061] in Japanese Patent Application No. 11-36308. Examples of diazonium salt compounds which can be appropriately used include, but are not limited to, the compounds disclosed from paragraph [0062] to paragraph [0077] in Japanese Patent Application No. 11-36308.

The substantially colorless compound B, which is used in the light and heat sensitive transfer layer (a) and has, within the same molecule, a polymerizable group and a site which reacts with the color-forming component A to form color, may be any compound that reacts with the color-forming component A to form color, such as an electron-accepting compound having a polymerizable group or a coupler compound having a polymerizable group or the like, and that reacts under light to be polymerized and cured. The electron-accepting compound having a polymerizable group, i.e., a compound having an electron-accepting group and a polymerizable group in the same molecule, may be any compound that has a polymerizable group, reacts with the electron-donating colorless dye, which is one form of the color-forming component A, to form color, and is able to cure the film by photo-polymerization. Examples of the electron-accepting compound having a polymerizable group include compounds disclosed from paragraph [0079] to paragraph [0088] in Japanese Patent Application No. 11-36308. Examples of the coupler compound include, but are not limited to, compounds disclosed from paragraph [0089] to paragraph [0105] in Japanese Patent Application No. 11-36308.

In the light and heat sensitive recording layers (b) through (d), as the compound which reacts with the color-forming component A to form color, instead of the compound B, which has a polymerizable group, the substantially colorless compound C, which does not have a polymerizable group and which reacts with the color-forming component A to form color, may be used. Here, as the compound C does not have a polymerizable group, in order to have the recording layer cure by photo-polymerization, the photo-polymerizable compound D having a polymerizable group is used is used in combination with compound C. As the compound C, any electron-accepting compound or coupler compound which does not have a polymerizable group may be used. Examples of the electron-accepting compound which does not have a polymerizable group are disclosed from paragraph [0107] to paragraph [0111] in Japanese Patent Application No. 11-36308. Examples of the coupler compound which does not have a polymerizable group include compounds disclosed from paragraph [0117] to paragraph [0126] in Japanese Patent Application No. 11-36308.

As the photo-polymerizable compound D, a photo-polymerizable monomer can be used. A photo-polymerizable monomer which has at least one vinyl group within a molecule may be used. In order to obtain a negative image, a photo-polymerizable compound Dp, which has a site for suppressing the reaction of the color-forming component A with the compound C, may be used as the photo-polymerizable compound. An appropriate photo-polymerizable compound Dp, i.e., a specific photo-polymerizable monomer (Dp1 or Dp2), is selected and used in accordance with the compound C to be used. If the electron-accepting compound which does not have a polymerizable group is used, the specific photo-polymerizable monomer Dp1 is used. The photo-polymerizable monomer Dp1 is preferably a photo-polymerizable monomer which has a reaction-inhibiting function for inhibiting the reaction between the electro-donating colorless dye and the electron-accepting compound and has at least one vinyl group within the molecule thereof. Examples of the photo-polymerizable monomer Dp1 include monomers disclosed from paragraph [0112] to paragraph [0116] in Japanese Patent Application No. 11-36308. When the coupler compound which does not have a polymerizable group is used, the specific photo-polymerizable monomer Dp2 is used in combination therewith. Examples of the photo-polymerizable monomer Dp2 include monomers disclosed from paragraph [0128] to paragraph [0131] in Japanese Patent Application No. 11-36308.

In the light and heat sensitive recording layers (b) through (d), an azomethine dye precursor may be used as the color-forming component A, and, as the compound C, a deprotective agent which generates an azomethine dye (thereby forming color) by contact with the azomethine dye precursor may be used. By using, as the photo-polymerizable compound, the photo-polymerizable compound (Dp) which has a site for suppressing the reaction of the azomethine dye precursor with the deprotective agent, a negative image can be obtained. Examples of the azomethine dye precursor that can be used in the present invention are described from paragraph [0028] to [0106] in Japanese Patent Application No. 2000-18425. Examples of the deprotective agent that can be used in the present invention are described in paragraphs [0143] to [0164] of Japanese Patent Application No. 2000-18425. Further, in the light and heat sensitive recording layer (a), an azomethine dye precursor can be used as the color-forming component A, and a deprotective agent can be used as the compound B. Examples of deprotective agents having a polymerizable group that can be used in the present invention are described in paragraphs [0233] to [0238] of Japanese Patent Application No. 2000-18425.

Examples of other combinations of color-forming component A and the compound B or C which reacts with the color-forming component A to form color include the following combinations (I) through (XV). In each combination, the color-forming component A and then the compound B or C are mentioned, in that order.

(I) A combination of an organic acid metal salt, such as silver behenate, silver stearate or the like, and a reducer, such as protocatechuic acid, spiroindane, hydroquinone or the like.

(II) A combination of an iron salt of a long-chained fatty acid, such as ferric stearate, ferric myristinate or the like, and a phenol, such as tannic acid, gallic acid, ammonium salicylate or the like;

(III) A combination of a heavy metal salt of an organic acid, such as a nickel, cobalt, zinc, copper, iron, mercury or silver salt of acetic acid, stearic acid, palmitic acid or the like, and an alkali metal or alkaline earth metal sulfide, such as calcium sulfide, strontium sulfide, potassium sulfide or the like; or a combination of a heavy metal salt of an organic acid and an organic chelating agent, such as s-diphenylcarbazide, diphenylcarbazone or the like.

(IV) A combination of a heavy metal sulfate salt, such as a sulfate of silver, zinc, mercury, sodium or the like, and a sulfur-containing compound, such as sodium tetrathionate, soda thiosulfate, thiourea or the like.

(V) A combination of an ferric salt of a fatty acid, such as ferric stearate, and an aromatic polyhydroxy compound, such as 3,4-hydroxytetraphenylmethane or the like.

(VI) A combination of a metal salt of an organic acid, such as silver oxalate, mercury oxalate or the like, and an organic polyhydroxy compound, such as polyhydroxyalcohol, glycerin, glycol or the like.

(VII) A combination of an ferric salt of a fatty acid, such as ferric pelargonate, ferric laurylate or the like, and a derivative of thiocesylcarbamide or isothiocesylcarbamide.

(VIII) A combination of a zinc salt of an organic acid, such as zinc caproate, zinc pelargonate, zinc behenate or the like, and a thiourea derivative, such as ethylenethiourea, N-dodecylthiourea or the like.

(IX) A combination of a heavy metal salt of a higher fatty acid, such as iron (III) stearate, copper stearate or the like, and zinc dialkyldithiocarbamate.

(X) A combination which forms an oxazine dye, such as a combination of resorcinol and a nitroso compound.

(XI) A combination of a formazan compound and a reducer and/or a metal salt.

(XII) A combination of an oxidization-type color-forming agent and an oxidizer.

(XIII) A combination of a phthalonitrile and a diiminoisoindoline (i.e., a combination that generates phthalocyanine).

(XIV) A combination of an isocyanate and a diiminoisoindoline (i.e., a combination that generates a coloring pigment).

(XV) A combination of a pigment precursor and an acid or a base (i.e., a combination that generates a pigment).

Among the above-mentioned combinations, the combination of an electron-donating dye precursor and an electron-accepting compound, a combination of a diazo compound and a coupler compound, a combination of a protected dye precursor and the deprotective agent, and a combination of a paraphenylene diamine derivative or para-aminophenol derivative oxidant precursor and a coupler compound are preferable. That is, as the color-forming component A, the electron-donating dye precursor, the diazo compound, the protected dye precursor or the oxidant precursor is preferable. As the compound B or the compound C, the electron-accepting compound, the coupler compound or the deprotective agent is preferable.

Next, the photoinitiator used in the light and heat sensitive recording layers (a) through (d) will be explained. The photoinitiator may be used in each of the light and heat sensitive recording layers (a) through (d). The photoinitiator can generate radicals when exposed to light and thereby cause the polymerization reaction within the layer. Further, the photoinitiator can accelerate the polymerization reaction. The recording layer film is cured by the polymerization reaction and thus a latent image of the desired image shape can be formed. The photoinitiator preferably contains a spectral sensitization compound which has a wavelength of maximum absorption in the range of 300 to 1,000 nm, and a compound that interacts with the spectral sensitization compound. If this compound that interacts with the spectral sensitization compound is a compound which has within its structure both a dye portion having a wavelength of maximum absorption in the range of 300 to 1,000 nm and a borate, the spectral sensitization compound need not be used. If a color image is to be formed, it is preferable to use a light and heat sensitive recording material that has a light and heat sensitive recording layer containing a photoinitiator that contains the spectral sensitization compound and/or the compound that interacts with the spectral sensitization compound. Examples of the photoinitiator that can be used in the present invention include, but are not limited to, photo-polymerizable monomers disclosed from paragraph [0133] to paragraph [0179] in Japanese Patent Application No. 11-36308.

Other additives in the light and heat sensitive recording layers, structures of layers other than the light and heat sensitive recording layers in the above-described light and heat sensitive recording material, and a method for encapsulating in microcapsules, which are suitably usable in the present invention, are described from paragraph [0180] to paragraph [0226] in Japanese Patent Application No. 11-36308.

In the present invention, in addition to light and heat sensitive recording materials that have the above-described light and heat sensitive recording layers (a) through (d), light and heat sensitive recording materials including light and heat sensitive recording layers (e) and (f) may be appropriately used. The light and heat sensitive recording layers (e) and (f) are as follows. The photo-curable light and heat sensitive layer (e) includes an oxidant precursor E which is encapsulated in thermally-responsive microcapsules, an activator G which exists outside the thermally-responsive microcapsules and which reacts with the oxidant precursor E to generate an oxidant F, and a dye forming coupler H which couples to the oxidant F to generate a dye. By irradiation of light, an irradiated portion of the light and heat sensitive recording layer (e) is cured. The light and heat sensitive recording layer (f) includes the oxidant precursor E, outside the thermally-responsive microcapsules, the activator G which is encapsulated in the thermally-responsive microcapsules and which reacts with the oxidant precursor E to generate the oxidant F, and the dye forming coupler H which couples to the oxidant F to form a dye. By irradiation of light, an irradiated portion is cured.

In the light and heat sensitive recording layer (e), by carrying out exposure of the desired image shape, the irradiated portion is cured and a latent image of the desired image shape is formed. Next, the activator G present in the unexposed portion moves within the recording material due to heating, and reacts with the oxidant precursor E within the capsules to generate the oxidant F. The generated oxidant F couples to the dye forming coupler H to form a dye (to form color). Accordingly, the light and heat sensitive recording layer (e) is a positive light and heat sensitive recording layer in which color is not formed at the exposed portion and uncured portions, the unexposed portion, form color so that an image is formed. Examples of such a light and heat sensitive recording layer include a light and heat sensitive recording layer disclosed in Japanese Patent Application No. 11-324548, which layer contains a para-phenylenediamine derivative or para-aminophenol derivative oxidant precursor which is encapsulated in microcapsules, a dye forming coupler, an activator which exists outside the microcapsules and which reacts with the oxidant precursor to form a para-phenylenediamine derivative or para-aminophenol derivative oxidant, a photo-polymerizable monomer, and a photoinitiator. In this light and heat sensitive recording layer, the photo-polymerizable monomer is polymerized and cured by exposure, so that a latent image is formed. Thereafter, the activator present at the unexposed portion moves within the recording material when heated, and reacts with the para-phenylenediamine derivative or para-aminophenol derivative oxidant precursor within the microcapsules to generate, within the microcapsules, the para-phenylenediamine derivative or para-aminophenol derivative oxidant, which is a color-forming developing agent. The color-forming developing agent oxidant further reacts with the dye forming coupler within the microcapsules to form color. Thus, color is not formed at the cured latent image portion of the exposed portion and only the uncured portions form color, so that a positive image with high contrast and high sharpness can be formed.

In the light and heat sensitive recording layer (f1, by effecting exposure of the desired image shape, the irradiated portion of the layer is cured, so that a latent image of the desired image shape is formed. Next, the oxidant precursor E present at the unexposed portion moves within the recording material during heating, and reacts with the activator G within the microcapsules to generate the oxidant F. The generated oxidant F couples to the dye forming coupler H to form a dye (to form color). Accordingly, the light and heat sensitive recording layer (f) is a positive light and heat sensitive recording layer in which color is not formed at the exposed portion and color is formed at the uncured portions, the unexposed portion, so that an image is formed. Specific examples of such a light and heat sensitive recording layer include a light and heat sensitive recording layer disclosed in Japanese Patent Application No. 11-324548, which layer contains a para-phenylenediamine derivative or para-aminophenol derivative oxidant precursor outside microcapsules, an activator which is encapsulated in the microcapsules and which reacts with the oxidant precursor to generate a para-phenylenediamine derivative or para-aminophenol derivative oxidant, a dye-forming coupler, a photo-polymerizable monomer, and a photoinitiator. In this light and heat sensitive recording layer, the photo-polymerizable monomer is polymerized and cured by exposure, so that a latent image is formed. Thereafter, the para-phenylenediamine derivative or para-aminophenol derivative oxidant precursor which exists at the exposed portion is moved within the recording material by heating, and reacts with the activator within the microcapsules so as to generate, within the microcapsules, the para-phenylenediamine derivative or para-aminophenol derivative oxidant, which is a color-forming developing agent. The color-forming developing agent oxidant further reacts with the dye-forming coupler within the microcapsules to form color. Accordingly, color is not formed at the cured latent image portion of the exposed portion, and only the uncured portions form color, so that a positive image with high contrast and high sharpness can be formed. Hereinafter, components for forming the above-described light and heat sensitive recording layers (e) and (f) will be explained in detail. The oxidant F generated in the light and heat sensitive recording layers (e) and (f) is a color-forming developing agent oxidant. Examples of the oxidant precursor E that can be used in the present invention include compounds disclosed from paragraph [0009] to paragraph [0024] in Japanese Patent Application No. 11-324548. Examples of the activator G that can be used in the present invention include compounds disclosed from paragraph [0024] to paragraph [0032] in Japanese Patent Application No. 11-324548. Examples of the dye-forming coupler H that can be used in the present invention include compounds disclosed in paragraph [0033] of Japanese Patent Application No. 11-324548.

As in the light and heat sensitive recording layers (b) to (d), by adding the photo-polymerizable compound D and the photoinitiator to the light and heat sensitive recording layers (e) and (f), a photo-curable light and heat sensitive recording layer can be formed. Further, a photo-curable light and heat sensitive recording layer can also be formed by making one of the oxidant precursor E, the activator G and the dye forming coupler H have a polymerizable group. By using, as the photo-polymerizable compound, the photo-polymerizable compound Dp, which has a strong interaction with either the oxidant F or the dye forming coupler H, a negative image can be obtained. The same photo-polymerizable compound D and the photoinitiator as those used in the light and heat sensitive recording layers (b) through (d) may be used. Additives for the light and heat sensitive recording layer, structures of layers other than the light and heat sensitive recording layer and encapsulating methods have been already described.

In addition, similarly to the light and heat sensitive recording layers (a) through (d), other additives in the light and heat sensitive recording layers, structures of layers other than the light and heat sensitive recording layers in the above-described light and heat sensitive recording material, and a method for encapsulating in microcapsules, which are suitably usable in the present invention, are described from paragraph [0180] to paragraph [0226] in Japanese Patent Application No. 11-36308.

What is claimed is:

1. A method for recording an image using light and heat sensitive recording material, the method comprising the steps of:

recording a latent image by exposing light and heat sensitive recording material to light while conveying the light and heat sensitive recording material in a direction of conveyance;

developing the latent image by heating while conveying the light and heat sensitive recording material in another direction which is opposite to the direction in the step of recording a latent image; and irradiating light for fixing a developed image.

2. The method according to claim 1, wherein, after the step of recording a latent image, further comprising the step of pausing conveyance of the light and heat sensitive recording material, prior to the step of developing the latent image by heating while conveying the light and heat sensitive recording material in said another direction.

3. The method according to claim 1, further comprising the steps of removing the light and heat sensitive recording material from an accommodation section and cutting the light and heat sensitive recording material, during one of the steps of removing the light and heat sensitive recording material from the accommodation section, the step of recording the latent image, the step of recording the latent image to the step of developing the latent image, and after the step of developing the latent image.

4. A system for recording an image on light and heat sensitive recording material, the system comprising:

(a) an optical recording section including a light source operable for exposing a light and heat sensitive recording material with light and recording a latent image;

(b) a heat-developing section operable for subjecting the latent image to heating for developing the latent image;

(c) a conveyor for conveying the light and heat sensitive recording material;

(d) a conveyance-controller controlling the conveyor such that the light and heat sensitive recording material is conveyed in one direction along a predetermined conveying path when the latent image is being recorded at the optical recording section, and the light and heat sensitive recording material is conveyed in an opposite direction along the conveying path, relative to the one direction, when the latent image is being developed at the heat-developing section; and (e) an optical fixing section operable for fixing a developed image.

5. The system according to claim 4, wherein the conveyance-control device controls the conveying mechanism such that the light and heat sensitive recording material is conveyed in the one direction along the conveying path, and thereafter is conveyed to a predetermined waiting position where conveyance is paused, and then is conveyed from the waiting position in the opposite direction.

6. The system according to claim 5, wherein the light and heat sensitive recording material is an elongate web.

7. The system according to claim 5, further comprising:

an accommodating section which accommodates light and heat sensitive recording material; and a feeder which feeds the light and heat sensitive recording material from the accommodating section to the conveyor.

8. The system according to claim 4, further comprising:

an accommodating section which accommodates light and heat sensitive recording material; and a feeder which feeds the light and heat sensitive recording material from the accommodating section to the conveyor.

9. The system according to claim 8, wherein the light and heat sensitive recording material is an elongate web.

10. The system according to claim 8, further comprising a cutting device provided along the conveying path, the cutting device cutting the light and heat sensitive recording material which has been supplied by the feeder from the accommodated section.

11. The system according to claim 10, wherein the cutting device cuts the light and heat sensitive recording material after the light and heat sensitive recording material has been supplied by the feeder from the accommodated section, and before the latent image has been recorded.

12. The system according to claim 10, wherein the cutting device cuts the light and heat sensitive recording material after the latent image has been recorded, and before the latent image has been developed.

13. The system according to claim 10, wherein the cutting device cuts the light and heat sensitive recording material after the latent image has been developed.

14. The system according to claim 4, wherein the light and heat sensitive recording material is an elongate web.

15. An image-recording system for recording an image on light and heat sensitive recording material, the image-recording system comprising:

(a) an optical recording section which exposes light and heat sensitive recording material and records a latent image;

(b) a heat-developing section which subjects the latent image to heating to develop the latent image;

(c) an optical fixing section including a light source which irradiates light to fix the developed image; and (d) a conveyance-control device including at least one pair of rollers, operable for conveying the light and heat sensitive recording material between the optical recording section, the heat-developing section and the optical fixing section, and comprising a controlling section which controls conveyance by the rollers.

16. The image-recording system according to claim 15, wherein the conveyance-control device includes a first conveying path along which the light and heat sensitive recording material is supplied to the heat-developing section, a second conveying path along which the light and heat sensitive recording material is bidirectionally conveyed between the heat-developing section and the optical recording section, and a third conveying path along which the light and heat sensitive recording material is conveyed from the second conveying path to the optical fixing section.

17. The image-recording system according to claim 16, wherein the conveyance-control device includes a switching portion operable to close one and open another of the first conveying path and the second conveying path for conveyance.

18. The image-recording system according to claim 15, wherein the conveyance-control device has a conveying path along which the light and heat sensitive recording material is bidirectionally conveyed between the heat-developing section, the optical recording section and the optical fixing section.

19. The image-recording system according to claim 18, wherein the optical fixing section includes a light-shielding shutter switchable between open and closed shutter positions.

20. The image-recording system according to claim 15, wherein the optical recording section includes a plurality of lasers operable for producing light of different wavelengths from another, and a polygon mirror operable for reflecting light from the lasers towards the light and heat sensitive recording material for recording a latent image thereon.

* * * * *